US005464290A

United States Patent [19]

Watanabe et al.

[11] Patent Number: 5,464,290

[45] Date of Patent: Nov. 7, 1995

[54] DEVICE AND METHOD FOR PRINTING CHARACTERS ON TAPE HAVING A CONTROLLER TO EVENLY SPACE CHARACTERS

[75] Inventors: Kenji Watanabe, Tokyo; Yoshiya Toyosawa, Suwa, both of Japan

[73] Assignees: King Jim Co., Ltd.; Seiko Epson Corporation, both of Tokyo, Japan

[21] Appl. No.: 334,019

[22] Filed: Nov. 2, 1994

[30] Foreign Application Priority Data

Nov. 9, 1993 [JP] Japan ..... 5-279146

[51] Int. Cl.[6] ..... B41J 19/00

[52] U.S. Cl. ..... 400/76; 400/3; 400/61; 395/102

[58] Field of Search ..... 400/3, 61, 9, 70, 400/1, 2, 63, 76; 395/110, 109, 148, 102

[56] References Cited

U.S. PATENT DOCUMENTS

| | | | |
|---|---|---|---|
| 5,222,818 | 6/1993 | Aikiyama et al. | 400/61 |
| 5,230,572 | 7/1993 | Hirono et al. | 400/3 |
| 5,314,256 | 5/1994 | Niwa | 400/61 |
| 5,322,375 | 6/1994 | Niwa et al. | 400/61 |
| 5,344,247 | 9/1994 | Sakurasi et al. | 400/61 |

FOREIGN PATENT DOCUMENTS

| | | |
|---|---|---|
| 5-185653 | 7/1993 | Japan . |
| 5-185654 | 7/1993 | Japan . |
| 5-185663 | 7/1993 | Japan . |
| 6-143690 | 5/1994 | Japan . |

*Primary Examiner*—Edgar S. Burr
*Assistant Examiner*—John S. Hilten
*Attorney, Agent, or Firm*—Oliff & Berridge

[57] ABSTRACT

A tape printing device which prints an input text consisting of one or more lines of characters on tape. In case of this tape printing device, a judgement portion judges whether the number of lines of characters of the input text is not less than two, and whether or not a character-size entrusting mode, in which a character size to be assigned to each line is automatically determined, is selected. Subsequently, in case where the character-size entrusting mode is selected and the number of lines of characters of the input text is not less than two, a character-size determination portion generates length information representing a length of each line, to which a same character size is assigned, and determines the character-size attribute of each line according to the length information in such a manner to equalize lengths of at least two longest lines of characters of the input text. Thereafter, a print portion performs a printing of the input text according to the determined character-size attribute of each line.

18 Claims, 7 Drawing Sheets

DEVICE AND METHOD FOR PRINTING CHARACTERS ON TAPE HAVING A CONTROLLER TO EVENLY SPACE CHARACTERS

BACKGROUND OF THE INVENTION

1. Field of The Invention

This invention generally relates to a device and a method for printing characters on tape (hereunder sometimes referred to simply as a tape printing device and a tape printing method, respectively), by which an input "text" consisting of a plurality of lines (or rows) of characters (incidentally, in the instant application, the term "text" means one or more lines of characters) can be printed on the tape, thereby creating a label. More particularly, this invention relates to a tape printing device being capable of determining the size of characters to be printed (hereunder sometimes referred to simply as the character size) on each line of an input text automatically (incidentally, a line pitch (namely, the distance between adjacent lines of a text) may be also determined). Further, this invention relates to a tape printing method, by which the character size (and the line pitch) can be automatically determined. Additionally, in the instant application, the term "a character" should be interpreted as a letter, digit or any other symbol.

2. Description of The Related Art

Generally, a tape printing device is operative to print an input text on a part of continuous tape if necessary, and is also operative to cut off a printed part (or piece) from the tape and thereafter eject the cut part of the tape therefrom. Recently, in view of the fact that a piece cut off from tape (hereunder sometimes referred to simply as a label) is put to a number of use, there has been proposed a tape printing device which can print not only an input text consisting of a single line of characters but another input text consisting of two or more lines of characters on a label.

In case of such a tape printing device, a user can designate or specify the number of lines of characters of an input text, the size of the characters and a line pitch, freely. However, in case of the conventional tape printing device, the size of the characters of and the line pitch corresponding to each line are designated separately from each other. Therefore, especially, in case where an input text consists of a large number of lines of characters, it takes a great deal of time to perform the designating of the character sizes and the line pitches on all of the lines of the characters of the text. Thus, the conventional tape printing device is very inconvenient to use. Practically, in case where the tape loaded in the device is changed into another tape of different width, a user often wishes that a label produced from the latter tape has the similar layout of the text printed thereon. Even in such a case, the size of characters of and the line pitch corresponding to each line should be designated separately from each other. From this point of view, the conventional tape printing device is very awkward.

If a text to be printed on tape consists of only one line of characters, a user can suitably designate or specify the size of characters and so on, because he can easily judge whether or not the text may be printed within the width of tape loaded in the device. However, if the number of lines of characters of the text is not less than two, it is often that a user makes an error in designating the character sizes and so forth and thus a resultant print becomes undesirable, depending on the width of tape loaded in the device.

To eliminate the aforesaid drawbacks of the conventional device, Applicant of the instant application has proposed another tape printing device in the Japanese Patent Application Laying-Open (Kokai) No. 6-143690. In case of this tape printing device, the combination of the character sizes respectively corresponding to a plurality of lines (in this case, three lines) can be freely designated by a user, based on the following information on the combinations of the relative character sizes respectively corresponding to (namely, assigned to) three lines: "SAME SIZE TO 3 LINES", "SMALL, SMALL AND LARGE", "SMALL, LARGE AND LARGE", "LARGE, SMALL AND SMALL" and "LARGE, LARGE AND SMALL". Subsequently, what is called an absolute value conversion is performed on the character sizes so that a text can be printed on tape. Namely, in case of this tape printing device, an operation of designating the character sizes is simplified by designating the combination of the relative character sizes instead of individually designating the character sizes (and line pitches) respectively assigned to lines.

Meanwhile, in case where a user does not designate (or specify) the character sizes respectively assigned to a plurality of lines of characters of a text, a tape printing device generally prints the text in accordance with data representing the default values of the character sizes. Further, in most tape printing devices, the default values of such character sizes are set in such a manner that a same character size is employed as the character size corresponding to each line.

Even in case that a same character size is employed for (namely, assigned to) all of the lines or rows, if the number of characters to be printed on a line changes depending on the transverse position (namely, the position in the direction of the width of tape) of the line, the longitudinal position (namely, the position in the direction of the length of tape) of the right end character of a line comes to change depending on the transverse position of the line in a label printed and ejected as described above, as shown in FIG. 7(A). Namely, an "empty space" is formed, especially, at the right side of short lines of characters (in other words, the irregularity in longitudinal positions of the right end characters of the lines occurs) in the right end portion of the label, as viewed in this figure.

Generally, when a user inputs a text consisting of a plurality of lines or rows by making the lines different in the number of characters from one another, the user often intends to make the lines have a same length by changing the character size, depending on the lines, as illustrated in FIG. 7(B).

Therefore, in case of the conventional tape printing device, a user first inputs a text consisting of a plurality of lines of characters without considering the character sizes respectively corresponding to the lines. Subsequently, the preferable arrangement of the printed characters is obtained by repeatedly performing a trial-and-error method or process which comprises the steps of designating or specifying the character sizes corresponding to the lines (by assigning a small character size to a long line and also assigning a large character size to a short line) and thereafter printing the text according to the designated character sizes to judge whether or not the arrangement of the printed characters is preferable. In case where a label having the preferable arrangement of the printed characters is not obtained as a result of performing the trial-and-error method, the user sometimes takes an undesirable and inappropriate measure (for instance, the deletion of a part of characters of the long line or row).

As described above, although an operation of designating the character sizes is simplified by designating the combination of the relative character sizes, the conventional tape printing device has drawbacks in that it takes plenty of time and labor to obtain a label on which characters arranged as intended by a user and that many useless labels may be produced on the way to make a desired label. The present invention is created to eliminate the drawbacks of the conventional tape printing device.

SUMMARY OF THE INVENTION

It is, therefore, an object of the present invention to provide a tape printing device being capable of obtaining a label, on which a text consisting of a plurality of lines of characters arranged as intended by a user is printed, without producing useless labels by lessening the user's burden as much as possible.

Further, it is another object of the present invention to provide a method for printing characters on tape (hereunder sometimes referred to simply as a tape printing method), by which a label, on which a text consisting of a plurality of lines of characters arranged as intended by a user is printed, can be obtained without producing useless labels, and the user's burden can be lessened as much as possible.

To achieve the foregoing object, in accordance with a first aspect of the present invention, there is provided a tape printing device for printing an input text consisting of one or more lines of characters on tape, for cutting off a printed part of the tape therefrom and for ejecting the cut part of the tape. The tape printing device is provided with a judgement portion, a character-size determination portion and a print portion. The judgement portion judges whether the number of lines of characters of the input text is not less than two, and whether or not a "character-size entrusting mode", in which a character size corresponding to each line is automatically determined, is selected. Further, in case where it is judged by the judgement portion that the character-size entrusting mode is selected and the number of lines of characters of the input text is not less than two, the character-size determination portion generates length information representing a length of each line, to which a same character size is assigned. Then, the character-size determination portion determines character-size attribute of each line according to the length information in such a manner to equalize lengths of at least two longest lines of characters of the input text. Thereafter, the print portion prints the input text according to the character-size attribute of each line, which is determined by the character-size determination portion.

Further, in accordance with a second aspect of the present invention, there is provided a tape printing method for printing an input text consisting of one or more lines of characters on tape, for cutting off a printed part of the tape therefrom and for ejecting the cut part of the tape. In case of the tape printing method, when the character-size entrusting mode is selected and the number of lines of characters of the input text is not less than two, length information representing a length of each line, to which a same character size is assigned, is first generated. Then, character-size attribute of each line is determined according to the length information in such a fashion to equalize lengths of at least two longest lines of characters of the input text. Next, the input text is printed according to the determined character-size attribute of each line.

Thus, in accordance with the device and method of the present invention, a label, on which a text consisting of a plurality of lines of characters arranged as intended by a user is printed without generating an unnatural empty space at the right of the printed text, can be easily obtained. Moreover, the production of useless labels can be prevented. Furthermore, a user's burden can be lessened as much as possible.

Moreover, in an embodiment of the aforesaid tape printing device of the present invention, the character-size determination portion is provided with a first unit, a second unit, a second judgement unit, a determination unit and a multiplication unit. The first unit generates the length information representing the length of each line obtained in case where the same character size is assigned to all of the lines. Then, the second unit tentatively determines the character size to be assigned to each of remaining lines other than the longest lines according to the length information so that the length of each of the remaining lines, which is calculated on the basis of the character size assigned thereto, becomes equal to the length of the longest line. Further, the second judgement unit judges whether or not a total sum of transverse sizes of all of the lines exceeds a predetermined limited size. The total sum of the transverse sizes is calculated on the basis of the character size assigned by the first unit to the longest line and of the character sizes which are assigned to the remaining lines, respectively, and determined tentatively by the second unit. Furthermore, in case where it is judged by the second judgement unit that the total sum of the transverse sizes of all of the lines does not exceed the predetermined limited size, the determination unit determines the character size assigned by the first unit to the longest line and the character sizes, which are assigned to the remaining lines, respectively, and are determined tentatively by the second unit, as the character size attributes of the lines. Further, in case where it is judged by the second judgement unit that the total sum of the transverse sizes (namely, line heights) of all of the lines exceeds the predetermined limited size, the multiplication unit multiplies each of the character sizes by a coefficient determined according to the limited size and the total sum of the transverse sizes of the lines. One of the character sizes is that assigned by the first unit to the longest line and the other of the character sizes are those assigned to the remaining lines, respectively, and determined tentatively by the second unit as the character size attribute of each of the lines. Moreover, the multiplication unit determines values, which are obtained as a result of such multiplications, as character-size attributes of the lines.

Moreover, in another embodiment of the tape printing device of the first aspect of the present invention, the character-size determination portion is provided with a first unit, a second unit and a determination unit. The first unit generates the length information representing the length of each of the lines, which is obtained in case where the same character size is assigned to all of the lines. Then, the second unit tentatively determines the character size to be assigned to each of remaining lines (namely, the lines other than the longest lines) according to the length information so that the length of each of the remaining lines, which is calculated on the basis of the character size assigned thereto, becomes equal to the length of the longest line. Further, the determination unit divides the predetermined limited size of the width of the tape into values respectively corresponding to all of the lines in proportion to the ratio between (or among) the character size assigned by the first unit to the longest line and the character sizes of the remaining lines determined by the second unit. Thereafter, the determination unit determines the values as character sizes assigned to all of the lines, respectively.

Furthermore, in still another embodiment of the tape printing device of the first aspect of the present invention, the character-size determination portion is provided with a first unit, a second unit and a determination unit. The first unit generates the length information representing the length of each of the lines, which is obtained in case where the same character size is assigned to all of the lines. Further, the second unit tentatively determines the character size to be assigned to each of remaining lines other than the longest lines according to the length information so that the length of each of the remaining lines, which is calculated on the basis of the character size assigned thereto, becomes as close as possible to the length of the longest line. Furthermore, the determination unit selects the combination of the character sizes, the ratio between (or among) which is closest to the ratio between (or among) the character sizes, from permissible combinations of character sizes preliminarily determined depending on the number of characters of the input text. One of the character sizes is that assigned by the first unit to the longest line and the other of the character sizes are those of the remaining lines determined by the second unit. Thereafter, the determination unit determines the character sizes of the selected combination as the character sizes assigned to all of the lines, respectively.

Additionally, in yet another embodiment of the tape printing device of the first aspect of the present invention, the character-size determination portion is provided with a generation unit, a selection unit and a determination unit. The generation unit generates the length information representing the length of each of the lines, which is obtained in case where the same character size is assigned to all of the lines. Then, from predetermined combinations of character sizes respectively corresponding to the lines, the selection unit selects one of the combination of the character sizes corresponding to the smallest difference in length between the longest line and the second longest line which are determined according to the length information. Incidentally, the length of the longest line is calculated on the basis of a smallest character size among the character sizes of the predetermined combinations, and on the other hand, the length of the second longest line is calculated on the basis of a second smallest character size among the character sizes of the predetermined combinations. Further, the determination unit determines the smallest one and the second smallest one of the character sizes of the selected combination as character-size attributes of the longest line and the second line determined according to the length information, respectively.

Further, in case of an embodiment of the aforementioned tape printing method of the second aspect of the present invention, the character-size attribute of each line is determined by performing the following process. Namely, the length information representing the length of each of the lines, which is obtained in case where the same character size is assigned to all of the lines, is first generated. Then, a character size to be assigned to each of remaining lines other than the longest lines is tentatively determined according to the length information in such a manner that the length of each of the remaining lines, which is calculated on the basis of the character size assigned thereto, becomes equal to the length of the longest line. Next, it is judged whether or not a total sum of transverse sizes of all of the lines exceeds a predetermined limited size. The total sum is calculated on the basis of the character size assigned to the longest line and of the character sizes which are assigned to the remaining lines, respectively, and are tentatively determined. In case where it is judged that the total sum of the transverse sizes of all of the lines does not exceed the predetermined limited size, the character size assigned to the longest line and the character sizes, which are respectively assigned to the remaining lines and are tentatively determined, are determined as the character size attributes of the lines. In contrast, in case where it is judged that the total sum of the transverse sizes of all of the lines exceeds the predetermined limited size, each of the character size assigned to the longest line and the character sizes, which are respectively assigned to the remaining lines and are tentatively determined as the character size attribute of each of the lines, is multiplied by a coefficient determined according to the limited size and to the total sum of the transverse sizes of the lines. Thereafter, the values obtained by the multiplications are determined as character-size attributes of the lines.

Moreover, in a further embodiment of the tape printing device of the second aspect of the present invention, the character-size attribute of each line is determined by performing the following process. Namely, first, the length information representing the length of each of the lines, which is obtained in case where the same character size is assigned to all of the lines, is generated. Subsequently, a character size to be assigned to each of the remaining lines other than the longest lines is tentatively determined according to the length information in such a fashion that the length of each of the remaining lines, which is calculated on the basis of the character size assigned thereto, becomes equal to the length of the longest line. Then, a predetermined limited size of the width of the tape is divided into values respectively corresponding to all of the lines in proportion to the ratio between (among) the character size assigned to the longest line and the determined character sizes of the remaining lines. Thereafter, the values are determined as character sizes assigned to all of the lines, respectively.

Furthermore, in still another embodiment of the tape printing method of the second aspect of the present invention, the character-size attribute of each line is determined by performing the following process. Namely, first, the length information representing the length of each of the lines, which is obtained in case where the same character size is assigned to all of the lines, is generated. Then, the character size to be assigned to each of remaining lines other than the longest lines is tentatively determined according to the length information in such a manner that the length of each of the remaining lines, which is calculated on the basis of the character size assigned thereto, become as close as possible to the length of the longest line. Subsequently, the combination of the character sizes, the ratio between (among) which is closest to a ratio between (among) the character size assigned to the longest line and the determined character sizes of the remaining lines, is selected from permissible combinations of character sizes preliminarily determined depending on the number of lines of characters of the input text. Thereafter, the character sizes of the selected combination are determined as the character sizes assigned to all of the lines, respectively.

Additionally, in yet another embodiment of the tape printing method of the second aspect of the present invention, the character-size attribute of each line is determined by performing the following process. Namely, first, the length information representing the length of each of the lines, which is obtained in case where the same character size is assigned to all of the lines, is generated. Then, one of the combination of the character sizes corresponding to the smallest difference in length between the longest line and the second longest line determined according to the length information is selected from predetermined combinations of character sizes respectively assigned to the lines. Incidentally, the length of the longest line is calculated on the basis of the smallest character size among the character sizes of the predetermined combinations, and moreover the length of the second longest line is calculated on the basis of the second smallest character size among the character sizes of the predetermined combinations. Thereafter, the smallest character size and the second smallest character of the character sizes of the selected combination are determined as character-size attributes of the longest line and the second line determined according to the length information, respectively.

In addition, in an additional embodiment of the tape printing method of the second aspect of the present invention, the character-size attribute of each line is determined by repeatedly performing the following process. Namely, the length information representing the length of each of the lines, which is obtained in case where the same character size is assigned to all of the lines, is first generated. Then, the character size to be assigned to each of the remaining lines other than the longest lines is tentatively determined according to the length information so that the length of each of the remaining lines, which is calculated on the basis of the character size assigned thereto, become as close as possible to the length of the longest line. Subsequently, it is judged whether or not a total sum of transverse sizes of all of the lines exceeds a predetermined limited size (incidentally, the total sum is calculated on the basis of the character size assigned to the longest line and of the character sizes which are assigned to the remaining lines, respectively, and are tentatively determined. Then, in case where it is judged in the third sub-step that the total sum of the transverse sizes of all of the lines does not exceed the predetermined limited size, the character size assigned to the longest line and the character sizes, which are respectively assigned to the remaining lines and are determined tentatively, are determined as the character size attributes of the lines. In contrast, in case where it is judged that the total sum of the transverse sizes of all of the lines exceeds the predetermined limited size, it is further judged whether or not there is the combination of the character sizes, each of which is smaller than and is ranked next to the character size tentatively determined, and whether or not such a combination satisfies the condition that the ratio among the character sizes of the combination is equal to the ratio among the character size assigned to the longest line and the character sizes which are respectively assigned to the remaining lines and are tentatively determined. In case where it is judged that there is such a combination, the character sizes of such a combination are determined as character size attributes of all of the lines. Thereafter, in case where it is judged that there is not such a combination, the character size assigned to the longest line is replaced with a character size which is smaller and is ranked next thereto.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which.

DETAILED DESCRIPTION OF THE PREFERRED EMBODIMENTS

Hereinafter, preferred embodiments of the present invention (namely, tape printing devices and methods according to the present invention) will be described in detail by referring to the accompanying drawings.

Figure 2:
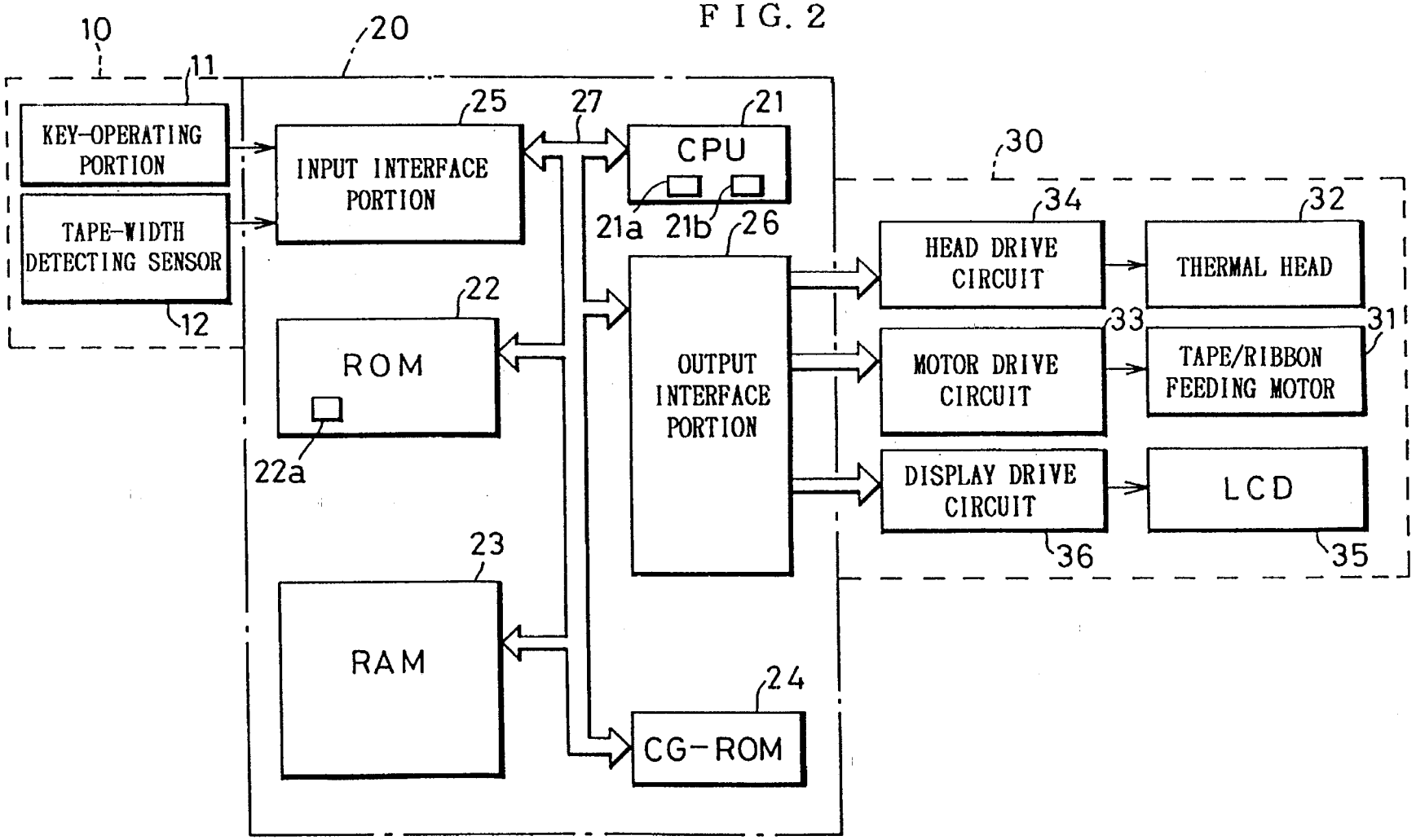
FIG. 2 is a schematic block diagram for illustrating the electrical circuit configuration of each of first to five embodiments of the present invention.

(A) Electrical Circuit Configuration of Entire Device Embodying The Present Invention First, the common electrical circuit configuration of the entire tape printing devices embodying the present invention (to be described later) will be described hereinbelow by referring to the schematic block diagram of FIG. 2.

As shown in this figure, the tape printing device mainly comprises an input portion 10, a control portion 20 and an output portion 30, similarly as other information processing systems like a word processor. The control portion 20 performs various processing according to information input from the input portion 10 and in accordance with a current step or stage of the processing. Further, results of the processing are displayed or printed by the Output portion 30.

To be brief, the input portion 10 comprises a key-operating portion 11 provided with pushdown keys and a dialing key, and a tape-width detecting sensor 12. (Incidentally, the detail description of the configuration of the input portion is omitted herein for the simplicity of description). Further, the key-operating portion 11 is used to generate character codes to be supplied to the control portion 20, as well as various control data. Moreover, the tape-width detecting sensor 12 is operative to detect the width of tape loaded in the tape printing device and to supply the control portion 20 information representing the detected width of tape (hereunder sometimes referred to simply as tape-width information). Practically, the tape is contained in a tape cartridge in which physical identification elements like holes are formed to define the width of the tape. The tape-width detecting sensor 12 is operative to read (or detect) the physical identification element and thereafter output the tape-width information.

The output portion 30 is composed of print elements and display elements. Tape/ribbon feeding motor 31, which may be composed of a stepping motor, is operative to feed a tape or an ink ribbon (not shown) loaded in the tape printing device to a predetermined printing position or to the outside thereof. Thermal head 32 fixed to the printing device is operative to print characters on the tape running thereon by performing what is called a thermal transfer printing, For example, the device can print a maximum of 96 dots simultaneously. The tape/ribbon feeding motor 31 and the thermal (print) head 32 are driven by the motor drive circuit 33 and the head drive circuit 34, respectively. The printed tape is cut by external forces exerted by, for example, a user or a cutter (not shown) driven by a motor (not shown).

In case of this tape printing device embodying the present invention, a liquid crystal display (LCD) 35 is provided in the body thereof as a display portion. This LCD 35 is driven by a display drive circuit 36 under the control of the control portion 20 and is operative to display a sequence of input characters, various kinds of attribute information and so forth directly on the screen (not shown) thereof and is also operative to turn on indicators on the screen thereof, which indicators respectively correspond to items of attributes represented by characters printed on the surface of the circumference portion (not shown) of the screen thereof.

The control portion 20 comprises, for example, a microcomputer. Further, as shown in this figure, a central processing unit (CPU) 21, a read-only memory (ROM) 22, a random access memory (RAM) 23, a character-generator ROM (CG-ROM) 24, an input interface portion 25 and an output interface portion 26 are connected with one another through a system bus 27.

Moreover, various processing programs and inalterable data (or constant data) like kana-kanji translation dictionary data are stored in the ROM 22. On the other hand, the RAM 23 is used as a work memory and is also operative to store inalterable data input by a user. Incidentally, when the power is turned off, the contents of the RAM 23 is backed up.

The processing programs and inalterable data stored in the ROM 22, as well as the data stored in the RAM 23, will be described in detail in the description of each of the embodiments (to be described later). Incidentally, in any of the embodiments to be described later, a processing program 22*a* to be executed in a "character-size entrusting mode" (to be described later) is stored in the ROM 22. Further, when executing the processing program 22, a work area to be used for the execution of the processing program is formed or established in the RAM 23.

Furthermore, the CG-ROM 24 stores information (hereunder sometimes referred to as font information) on the fonts of characters (namely, letters, digits, or other symbols), which are supported by the tape printing device embodying the present invention. When code data specifying a character (namely, a letter, digit or other symbol) is given, font information corresponding to the character is output from the CG-ROM 24. Here, note that either outline fonts or bitmap fonts may be employed as the fonts designated by the font information which is stored in the CG-ROM 24. In cases of the first and second embodiments (to be described later), the CG-ROM 24 stores font information representing outline fonts. In contrast, in cases of the third to fifth embodiments, the CG-ROM 24 stores font information designating bitmap fonts.

The input interface portion 25 is operative to provide the interface between the input portion 10 and the control portion 20. Further, the output interface portion 26 is operative to provide the interface between the output portion 30 and the control portion 20.

Moreover, the CPU 21 processes an input signal sent from the input portion 10 and executes a processing program, which is stored in the ROM 22 and corresponds to a current stage of the processing, by utilizing the work area established in the RAM 23 and by suitably using the inalterable data stored in the ROM 22 and in the RAM 23, if necessary. Furthermore, the CPU 21 causes the LCD 35 to display information representing the situation or results of the processing on the screen thereof and also causes the thermal head to print such information on tape (not shown). Additionally, a judgement portion 21*a* is operative to judge whether the number of lines of characters of an input text is not less than two, and whether or not the character-size entrusting mode is selected. Further, a character-size determination portion 21*b* is operative to execute the program 22*a* and generate the length information representing the length of each line, to which a same character size is assigned, in case where it is judged by the judgement portion that the character-size entrusting mode is selected and the number of lines of characters of the input text is not less than two. Moreover, the character-size determination portion 21*b* is operative to determine the character-size attribute of each line according to the length information in such a manner to equalize lengths of at least two longest lines of characters of the input text.

(B) Other Features Common to First through Fifth Embodiments

Hereinafter, features common to the first to fifth embodiments of the present invention other than the above described electrical circuit configuration will be described prior to the detail description of each of the embodiments.

The first to fifth embodiments of the present invention are characterized by having a character-size entrusting mode in which a user does not designate or specify the character size corresponding to (or assigned to) each of lines of characters of a text and the tape printing device automatically determines an optimum character size for each of the lines of characters.

Figure 7:
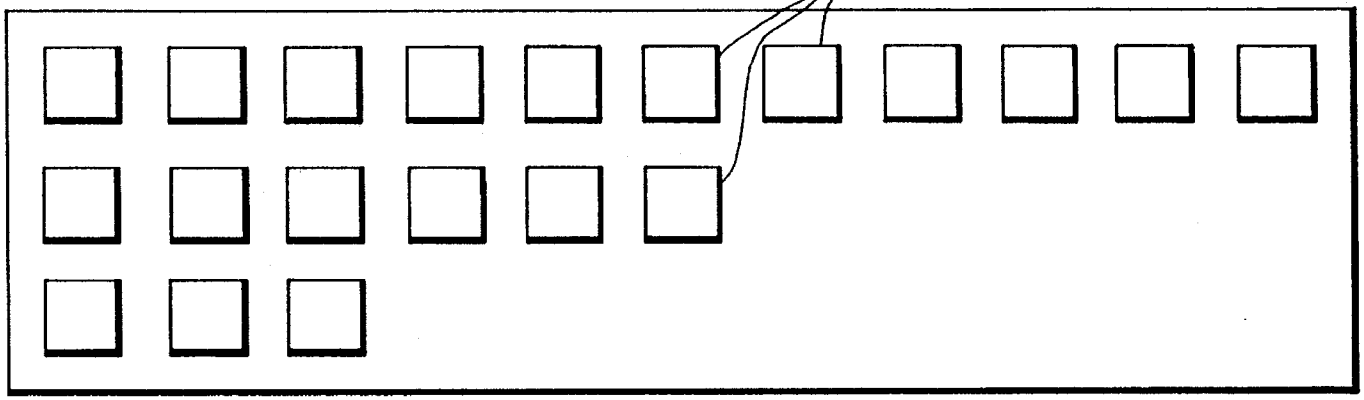
FIG. 7 (A) PRIOR ART
FIGS. 7(A) and 7(B) are diagrams for illustrating drawbacks of a conventional tape printing device.
Figure 7:
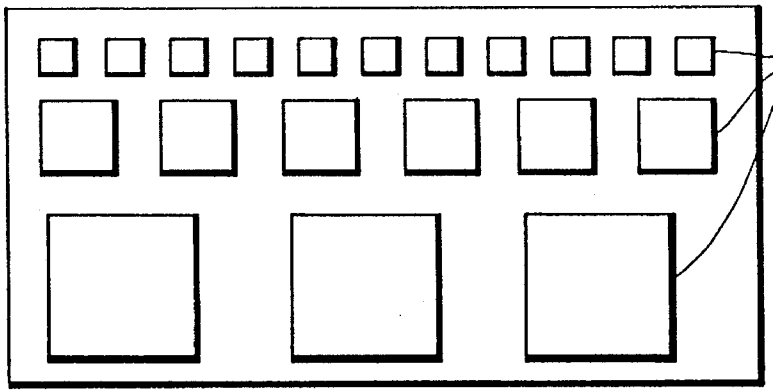
FIG. 7 (B) PRIOR ART

In the Japanese Patent Application Laying-Open (Kokai) No. 6-143690, Applicants of the instant application have disclosed another automatic mode in which a user does not designate the character size assigned to (or corresponding to) each of lines of characters of a text and the tape printing device automatically determines or sets a character size corresponding to (namely, assigned to) each of the lines of characters. However, in this automatic mode, the tape printing device automatically determines or sets a same character size as the character size to be used for all of the lines of characters (namely, the tape printing device automatically assigns a same character size to all of the lines of characters). Thus, this automatic mode is different from a mode in which a different character size is set or employed correspondingly to each of the lines of characters as illustrated in FIG. 7(B).

In contrast, in cases of the first to fifth embodiments of the present invention, in the character-size entrusting mode, the tape printing device automatically determines or sets the character size corresponding to (namely, assigned to) each of the lines of characters by taking the length of each of the lines into consideration in such a manner that each of the lines can have a same length in printed output on tape. Processing to be performed on a text consisting of a single line of characters in the character-size entrusting mode is similar to that to be performed in the automatic mode described in the Japanese Patent Application Laying-Open (Kokai) No. 6-143690. Therefore, the description of the processing to be performed on a text consisting of a single line of characters is omitted herein for the brevity of description.

Data representing default value of each attribute (hereunder sometimes referred to simply as default value data) is stored in the ROM 22 of the tape printing device of the present invention. Regarding character sizes, data indicating the character-size entrusting mode is stored therein as the default value data. Therefore, the character-size attribute of each of the lines of characters of an input text is set to the character-size entrusting mode, unless a user designates or specifies the character size corresponding to (namely, assigned to) each of the lines. Incidentally, sometimes, a text to be printed on a part of tape is composed of two or more sub-texts (hereunder referred to as text sections) to be respectively printed on partitions of the part, which are contiguously aligned in the longitudinal direction of the tape. Further, each text section contains one or more lines of characters, and the line pitch assigned to at least one text section is different from the line pitches respectively assigned to the other text sections of the text (namely, the number of lines of characters contained in at least one of the text sections is different from the number of lines of characters contained in each of the other text sections). In such a case, the respective character-size attributes of the lines of each of the text sections are set to the character-size entrusting mode. In the following descriptions of the first to fifth embodiments, for the simplicity of description, the processing to be performed on a text consisting of a single text section in the character-size entrusting mode will be explained by way of example. In case where the text consists of a plurality of text sections, such a processing is repeatedly performed on each of the text sections.

Hereunder, the first to fifth embodiments of the present invention will be described, provided that in case where the tape printing device is set in the character-size entrusting mode, the process of practically determining the character size corresponding to (namely, assigned to) each line is performed when instructing the thermal head to print characters.

Moreover, the process of determining the character size in the character-size entrusting mode may be performed by a dedicated hardware logic. However, the first to fifth embodiments will be described, assuming that the CPU 21 executes the processing program 22*a* preliminarily stored in the ROM 22.

Incidentally, in case of the embodiments of the present invention, the determining of the character sizes respectively assigned to the lines of characters of a text entails the determining of the line pitch (namely, the distance between the adjoining lines) assigned to the text. Generally, the character sizes and the line pitch are determined independently from each other in a word processor. In cases of existing tape printing devices, the maximum number of lines and that of dots arranged in the direction of the width (namely, in the transverse direction) of tape are preliminarily set or determined. Thus, as above stated, the determining of the character size involves that of the line pitch. In cases of the embodiments which will be described hereinbelow, the line pitch is automatically determined as the character size is determined.

(C) First Embodiment

Figure 1:
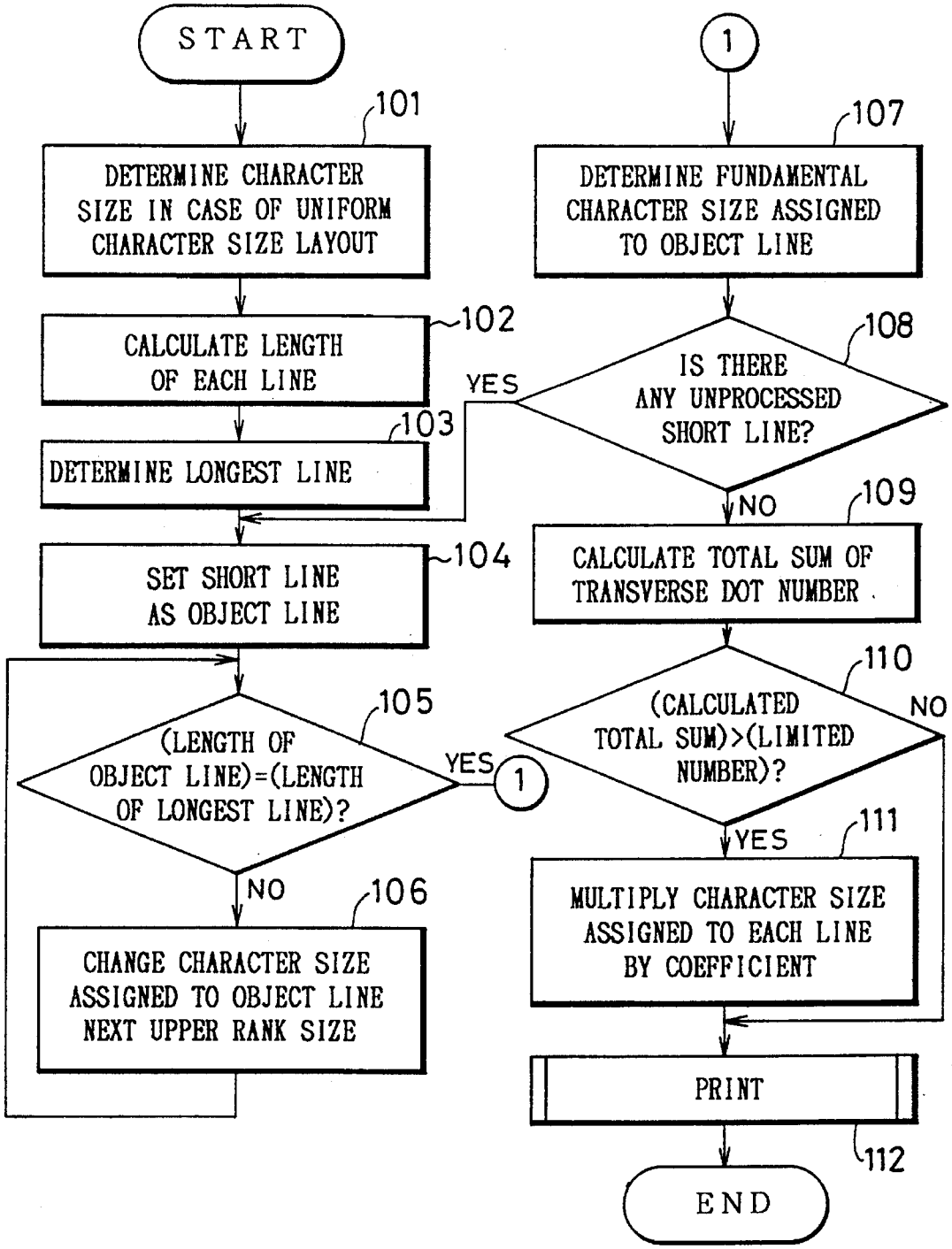
FIG. 1 is a flowchart for illustrating a process to be performed in a character-size entrusting mode of a first embodiment of the present invention.

Hereinafter, the first embodiment of the present invention will be described by referring to the accompanying drawings. FIG. 1 is a flowchart for illustrating the processing program 22*a* to be executed in the character-size entrusting mode in the first embodiment to print a text consisting of a plurality of lines of characters. Incidentally, as described above, in case of the first embodiment, it is assumed that the font information stored in the CG-ROM 24 represents outline fonts.

When instructing the output portion to print a text currently displayed on the screen of the LCD 35, the CPU 21 checks the character size attribute concerning the text and the number of lines of characters of the text. If the character-size entrusting mode is set as the character size attribute and further the number of lines is not less than two, the device initiates the process illustrated in FIG. 1.

First, the character size assigned to a line, which is obtained by equalizing the character sizes respectively corresponding to (namely, assigned to) the lines and dividing the limited number of dots aligned in the direction of the width of tape (to be described later) by the number of lines (namely, is obtained by what is called a "uniform character-size layout"), is tentatively determined or set as the fundamental character size assigned to each line (in step 101). For example, in case where the number of dots which can be printed by the thermal head 32 is 96 and moreover the text consists of two lines of characters, the fundamental character size assigned to each of the lines is tentatively set to 48×48. Further, in case where the number of dots which can be printed by the thermal head 32 is 96 and the text consists of three lines, the fundamental character size assigned to each of the lines is tentatively set to 32×32. Incidentally, in the instant application, a character size (namely, the size of a character) is represented by a product of the number of dots in the longitudinal direction of a dot matrix used to form the character (hereunder sometimes referred to simply as a longitudinal dot number) and the number of dots in the transverse direction of the dot matrix (hereunder sometimes referred to simply as a transverse dot number). Next, in step 102, the length of each of the lines is calculated according to the character size tentatively set as described above (hereunder sometimes referred to as the tentative (fundamental) character size). Then, the longest line is determined from the results of comparisons among the obtained lengths of the lines (in step 103). Incidentally, in case of the first embodiment, a character size being different from the fundamental character size assigned to a line may be assigned to a part of characters of the line. Therefore, the length of a line is obtained by calculating a total sum of the longitudinal dot numbers of the character sizes of the characters of the line, instead of calculating a product of the number of characters and the longitudinal dot number of the fundamental character size.

If the longest line is determined, a short line (namely, one of the lines which are shorter than the longest line) is set (in step 104) as an object (line). Then, it is checked (in step 105) whether or not the length of this short line, which is calculated on the basis of a current tentative fundamental character size, is equal to that of the longest line (in step 105). In case where the length of this short line is not equal to that of the longest line, the character size assigned to the object line is changed to a next upper rank size (in step 6). Subsequently, the program returns to the step 105. Further, such a "searching" process is repeatedly performed until the length calculated on the basis of a tentative fundamental character size corresponding to this short line becomes equal to the length of the longest line (namely, until such a tentative fundamental character size is found). This tentative fundamental character size found as a result of the searching process is temporarily determined as the (definite) fundamental character size corresponding to (namely, assigned to) this short line (in step 107).

Incidentally, the process or method of "searching" for the definite fundamental character size may be performed by increasing the tentative fundamental character size gradually (hereunder referred to as a first searching method). Alternatively, the "searching" process or method may be carried out by selecting an intermediate character size between character sizes, of which the corresponding lengths of a short line are already checked, and next checking whether or not the length of the short line, which is calculated by using the selected intermediate character size, is equal to the length of the longest line (hereunder referred to as a second searching method). For example, first, a character size twice an initial tentative fundamental character size is selected. Subsequently, the length of the short line is calculated by using the selected character size. Then, the calculated length of the short line is checked. If the calculated length of the short line is longer than the length of the longest line, then a character size 1.5 times the initial tentative fundamental character size is selected and next the length of the short line is computed by using this selected character size. Then, the computed length of the short line is checked. If the computed length of the short line is shorter than the length of the longest line, then a character size 1.75 times the initial tentative fundamental character is selected. Subsequently, the length of the Short line is calculated by using the selected character size. Thereafter, the calculated length of the short line is checked. In contrast, if the length computed by using the character size 1.5 times the initial tentative fundamental character size is longer than that of the longest line, a character size 1.25 times the initial tentative fundamental character is then selected and subsequently, the length of the short line is computed. Thereafter, the computed length of the short line is checked. In this way, the search will be continued until the definite fundamental character size is found.

Practically, an average operation time in case of the second searching method is shorter than that in case of the first searching method. When performing the second searching method, the intermediate character size may be obtained by adding a half of the difference between the two character sizes, of which the corresponding lengths of the short line are already checked, to the smaller one of the two character sizes. For instance, an intermediate size between character sizes 48×48 (dots) and 32×32 (dots) is 40×40 (dots), found by (48−32)/2+32=40. Here, note that generally, an addition and a subtraction can easily be performed and that an operation of dividing binary data by 2 can easily be carried out by shifting the data right by one bit position.

When the (definite) fundamental character size corresponding to (namely, to be assigned to) a short line is determined in the aforementioned way, it is checked (in step 108) whether or not the determining of the definite fundamental character sizes respectively corresponding to all of the short lines of characters is completed. If not completed, the program returns to the step 104 whereupon the determining of the definite fundamental character size corresponding to another line is commenced.

Thus, the definite fundamental character sizes respectively corresponding to all of the short lines are temporarily determined by repeatedly performing the aforementioned "searching" process. Further, when this is verified in step 108, a total sum of the transverse dot numbers (namely, the number of dots in the transverse direction of the tape) respectively corresponding to all of the definite fundamental character sizes determined as to each line is calculated (in step 109). Then, the calculated total sum of the transverse dot numbers is compared with the limited number of dots aligned in the direction of the width of tape. Further, it is judged from the result of this comparison (in step 110) whether the definite fundamental character size corresponding to each line presents no problem in view of the limited number of dots aligned in the traverse direction of tape (namely, whether or not the definite fundamental character sizes raise a problem that the calculated total sum of the transverse dot numbers exceed the limited number of dots aligned in the transverse direction of tape).

Incidentally, note that the limited number of dots aligned in the transverse direction (namely, in the direction of the width) of tape may be the number of dots which the tape printing device can print on tape in the traverse direction thereof (namely, the transverse dot number (namely, the number of dots in the direction of the width of tape) of the thermal head 32), or may be a maximum number of dots which can be aligned within the width of tape, which is detected by the tape-width detecting sensor 12. Additionally, in the former case (namely, in case of employing the number of dots which can be printed on tape in the traverse direction), it is sometimes requested in a more practical printing process (to be described later) to load a broad or wide tape in the tape printing device and further change the character sizes according to the width of the tape.

In case where it is judged that there is no problem (for example, in case where all of the lines have a same length from the beginning), the program immediately advances to step 112 whereupon the more practical printing process is performed (for instance, the dot pattern of the text and blanks (or space) are generated and moreover the head 32 and the motor 31 are activated and driven). In contrast, in case where the definite fundamental character size corresponding to (namely, assigned to) each line raises a problem in view of the limited number of dots aligned in the traverse direction of tape, the definite fundamental character size is updated and reduced by being multiplied by a ratio of the definite fundamental character size to the limited number of dots aligned in the traverse direction of tape (in step 111). Then, the program advances to step 112 and starts performing the more practical printing process.

As described above, in case of the first embodiment of the present invention, data representing the character-size entrusting mode is stored as the default value data corresponding to the character size. Further, in case of employing this mode, the fundamental character size corresponding to.(namely, to be assigned to) each line is automatically determined to print a text. Thereby, a label, on which a text consisting of a plurality of lines of characters arranged as intended by a user is printed, can be easily obtained without producing useless labels which would be generated in a try-and-error process performed in the conventional device, by lessening a user's burden as much as possible.

Especially, in case of the tape printing device of the present invention, the lengths of the lines of characters can be made to be precisely equal to one another, because the outline fonts are employed.

Incidentally, there is another method for equalizing the lengths of lines of characters of a text, namely, what is called a "justification" method usually employed in word processors. In case of performing this justification method, a same character size is employed for all of lines of characters and, in contrast, the pitch (namely, the distance between adjacent characters) may be changed every line. However, in cases of labels to be produced by the tape printing device, the pitch employed for a short line sometimes becomes very large to the extent that characters on this short line can not be recognized as a sequence of characters. Therefore, in case of the tape printing device, this justification method is unpractical or impractical.

(D) Second Embodiment

Figure 3:
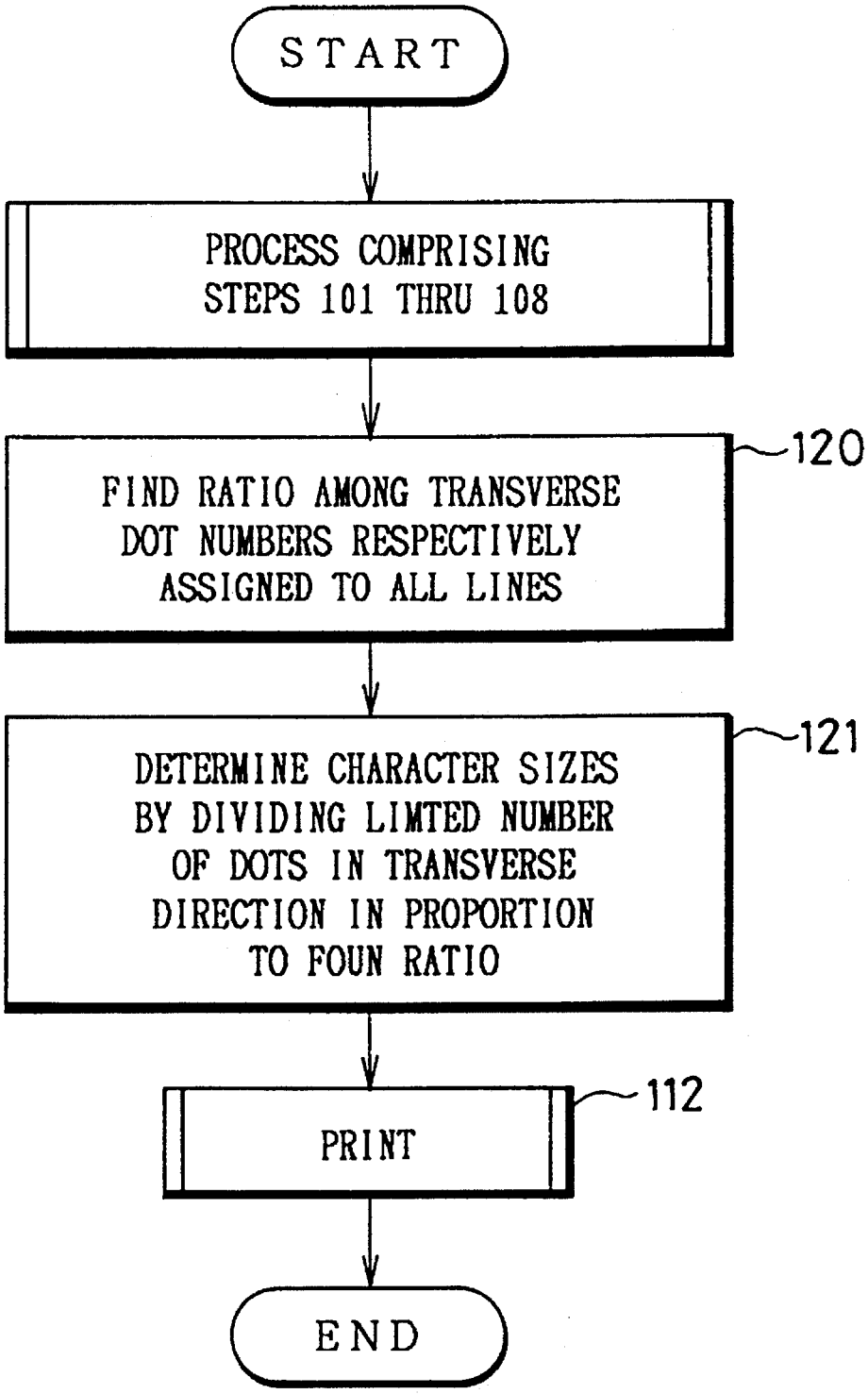
FIG. 3 is a flowchart for illustrating a process to be performed in a character-size entrusting mode of the second embodiment of the present invention.

Next, the second embodiment of the present invention will be described in detail hereinbelow by referring to the accompanying drawings. FIG. 3 is a flowchart for illustrating the processing program 22*a* to be executed in the character-size entrusting mode in the second embodiment to print a text consisting of a plurality of lines of characters. Incidentally, as described above, in case of the second embodiment, it is assumed that the font information stored in the CG-ROM 24 represents outline fonts.

In case of the second embodiment of the present invention, when instructing the output portion to print a text currently displayed on the screen of the LCD 35, the CPU 21 verifies the -character size attribute concerning the text and the number of lines of characters of the text. If the character-size entrusting mode is set as the character size attribute and the number of lines is not less than two, the device commences performing the process illustrated in FIG. 3. Incidentally, in this figure, like reference numerals indicates like or corresponding steps of FIG. 1.

In case of the second embodiment, the process of temporarily determining the definite fundamental character sizes respectively corresponding to all of the lines is the same as the process comprising the steps 101 to 108 of the first embodiment. Therefore, the description of such a process is omitted herein for the simplicity of description.

When the definite fundamental character sizes respectively corresponding to all of the lines are determined temporarily, the CPU 21 finds a ratio between (or among) the transverse dot numbers of the definite fundamental character sizes (in step 120). For example, if a text to be printed on tape is composed of three lines of characters and moreover, the definite fundamental character sizes respectively corresponding to the three lines are 48×48 dots, 32×32 dots and 40×40 dots, the ratio 48:32:40=6:4:5 is obtained in step 120.

Next, the limited number of dots in the traverse direction of tape are distributed among the three lines according to the obtained ratio (incidentally, as described above, the limited number of dots may be the number of dots which the tape printing device can print on tape in the traverse direction thereof (namely, the transverse dot number of the thermal head 32) or a maximum number of dots which can be aligned within the width currently detected by the tape-width detecting sensor 12). Thus, the fundamental character sizes respectively corresponding to the lines are determined (in step 121). For instance, if the limited number of dots aligned in the transverse direction, namely, in the direction of the width of tape is 96 (dots) and the obtained ratio is 5:3:4, the fundamental character size corresponding to the first line is 40×40 dots, found by 96×5/12=40. Further, the fundamental character size assigned to the second line is 24×24 dots, found by 96×3/12=24. Furthermore, the fundamental character size corresponding to the third line is 32×32 dots, found by 96×4/12=32.

Thus, the more practical printing process (involving, for instance, the generating of the dot pattern of the text and the blanks and the driving of the head 32 and the motor 31) is performed (in step 112) according to the character size obtained correspondingly to the lines.

Thus, in case of the second embodiment of the present invention, data representing the character-size entrusting mode is stored as the default value data corresponding to the character size, similarly as in case of the first embodiment of the present invention. Further, when employing this mode, the fundamental character size corresponding to (namely, to be assigned to) each line is automatically determined and a text is printed on tape. Thereby, a label, on which a text consisting of a plurality of lines of characters arranged as intended by a user is printed, can be easily obtained without producing useless labels by lessening a user's burden as much as possible. Moreover, because the outline fonts are used in case of the second embodiment of the present invention, the lengths of the lines of characters can be made to be precisely equal to one another.

(E) Third Embodiment

Figure 4:
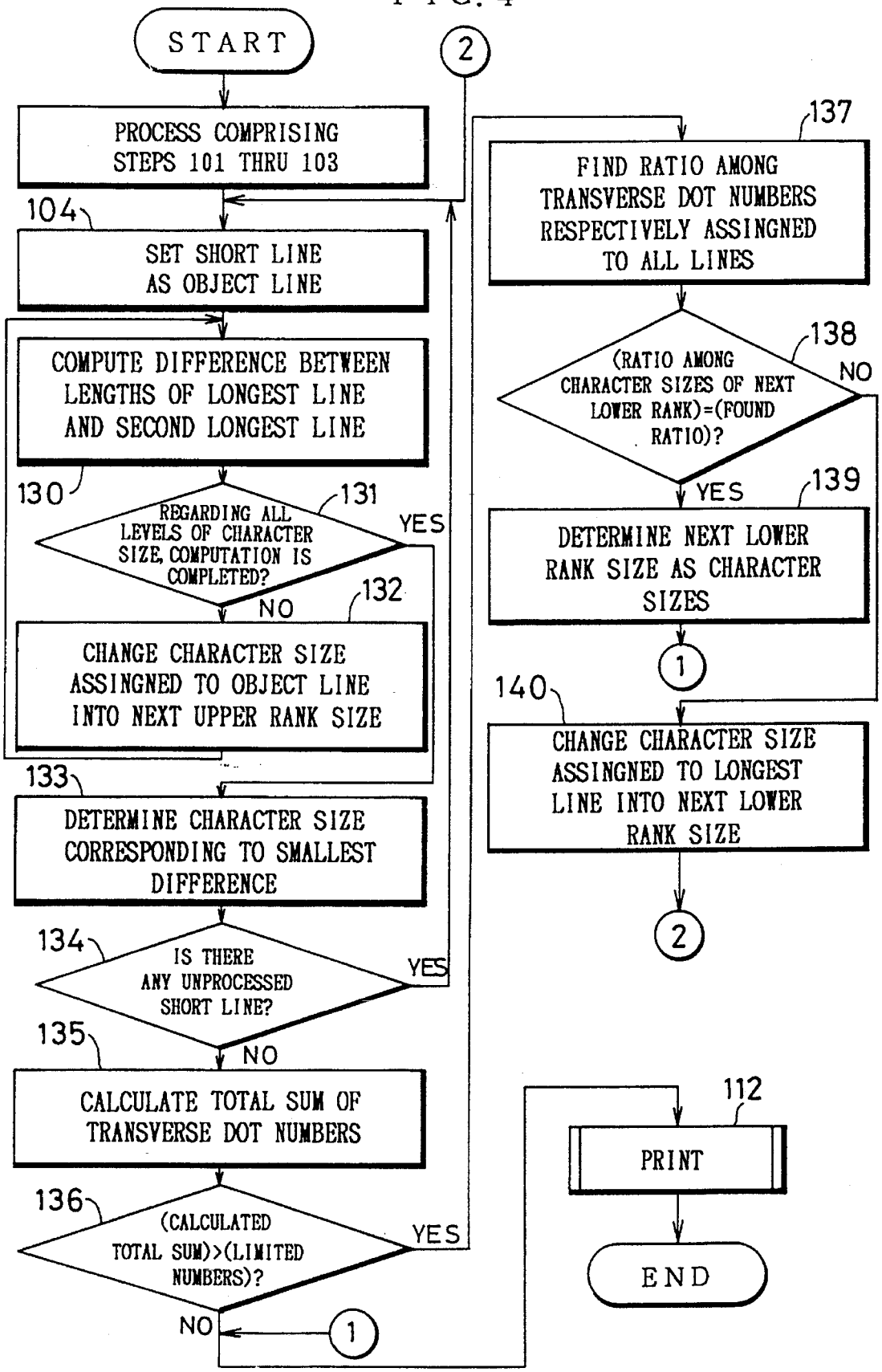
FIG. 4 is a flowchart for illustrating a process to be performed in a character-size entrusting mode of the third embodiment of the present invention.

Next, the third embodiment of the present invention will be described in detail hereinbelow by referring to the accompanying drawings. FIG. 4 is a flowchart for illustrating the processing program 22*a* to be executed in the character-size entrusting mode in the third embodiment to print a text consisting of a plurality of lines of characters. Incidentally, as stated above, in case of the third embodiment, it is assumed that the font information stored in the CG-ROM 24 represents bitmap fonts.

In case of the third embodiment of the present invention, when .instructing the output portion to print a text currently displayed on the screen of the LCD 35, the CPU 21 verifies the character size attribute concerning the text and the number of lines of characters of the text. If the character-size entrusting mode is set as the character size attribute and the number of lines is two or more, the device starts performing the process illustrated in FIG. 4. Incidentally, in this figure, like reference numerals indicates like or corresponding steps of FIG. 1.

In case of the third embodiment, the process of temporarily determining the tentative fundamental character sizes corresponding to (namely, to be assigned to) each of the lines, finding the longest line and selecting a shorter line as an object of the "searching" process is the same as the process comprising the steps 101 to 104 of the first embodiment. Therefore, the description of such a process is omitted herein for the brevity of description.

After a short line is selected (in step 104) as an object of the "searching" process, the tentative fundamental character size corresponding to (namely, assigned to) the selected short line is increased (in step 132) from the smallest one of the possible levels of the fundamental character size to the largest one thereof by stages. Further, at each stage of the process of increasing the tentative fundamental character size, the difference between the length of the longest line and the length calculated from the current level of the tentative fundamental character size is computed (in step 130). Finally, the tentative fundamental character size corresponding to the smallest difference is temporarily determined as the definite fundamental character size corresponding to the short line (in step 133).

In case of employing bitmap fonts, several discrete levels of the character size are available in the tape printing device. Thus, while the process of "searching" for the definite fundamental character size corresponding to the short line is performed, the tentative fundamental character size can be changed among the discrete levels thereof. Therefore, even when using the most appropriate level of the definite fundamental character size found as a result of the "searching" process, the calculated length of the short line is sometimes not equal to the length of the longest line. Therefore, the tentative fundamental character size corresponding to the smallest difference is a most appropriate level of the character size to be employed as the definite fundamental character size to be assigned to the short line.

When the definite fundamental character size to be assigned to this short line is determined in the aforementioned way, it is checked (in step 134) whether or not the determining of the definite fundamental character sizes respectively assigned to all of the short lines of characters is finished (namely, whether or not there is an unprocessed short line to which no definite fundamental character size is assigned). If not finished, the program returns to the step 104 whereupon the determining of the definite fundamental character size to be assigned to another line is started.

Thus, the definite fundamental character sizes respectively assigned to all of the short lines are temporarily determined by repeatedly performing the aforesaid "searching" process. Further, when this is verified in step 134, a total sum of the transverse dot numbers respectively corresponding to all of the definite fundamental character sizes determined as above described is computed (in step 135). Subsequently, the computed total sum of the transverse dot numbers is compared with the limited number of dots aligned in the direction of the width (namely, in the transverse direction) of tape. Further, it is judged from the result of this comparison (in step 136) whether the definite fundamental character size corresponding to each line presents no problem in view of the limited number of dots aligned in the traverse direction of tape.

If it is judged from a result of the comparison that there is no problem (for instance, in case where all of the lines have an approximately same length from the beginning), the program immediately goes forward to step 112 to perform the more practical printing process (for example, to generate the dot pattern of the text and blanks and to drive the head 32 and the motor 31). In contrast, in case where the definite fundamental character size corresponding to each line raises a problem in view of the limited number of dots aligned in the traverse direction of tape (namely, the computed total sum of the transverse dot numbers exceed the limited number), a ratio between (or among) the transverse dot numbers of the definite fundamental character sizes is calculated (in step 137). Subsequently, it is checked in step 138 whether or not the ratio between (or among) the character sizes (hereunder referred to as the next lower rank character sizes), each of which is smaller than and is ranked next to the definite fundamental character size assigned to each line of characters of the text, is equal to the ratio calculated in step 137. If it is found in step 138 that the ratio is equal to the ratio obtained in step 137, the next rank character sizes are finally determined as the definite fundamental character sizes in step 139. Then, the program advances to step 112 to start the more practical printing process. In contrast, if not, the character size, which is smaller than and is ranked next to the definite fundamental character size assigned to the longest line, is determined in step 140 as a new definite fundamental character size assigned thereto. Thereafter, the program returns to step 104 and the determining of the definite fundamental character sizes corresponding to each line is started all over again on the basis of the length of the longest line computed from the new definite fundamental character size.

Thus, in case of the third embodiment of the present invention, data representing the character-size entrusting mode is stored as the default value data corresponding to the character size, similarly as in case of the first and second embodiments of the present invention. Further, when employing this mode, the fundamental character size to be assigned to each line is automatically determined and a text is printed on tape. Thereby, a label, on which a text consisting of a plurality of lines of characters arranged as intended by a user is printed, can be easily obtained without producing useless labels by lessening a user's burden as much as possible.

Moreover, generally, the tape printing device employing the bitmap fonts similarly as the third embodiment can perform the "searching" process faster than those employing the outline fonts.

(F) Fourth Embodiment

Figure 5:
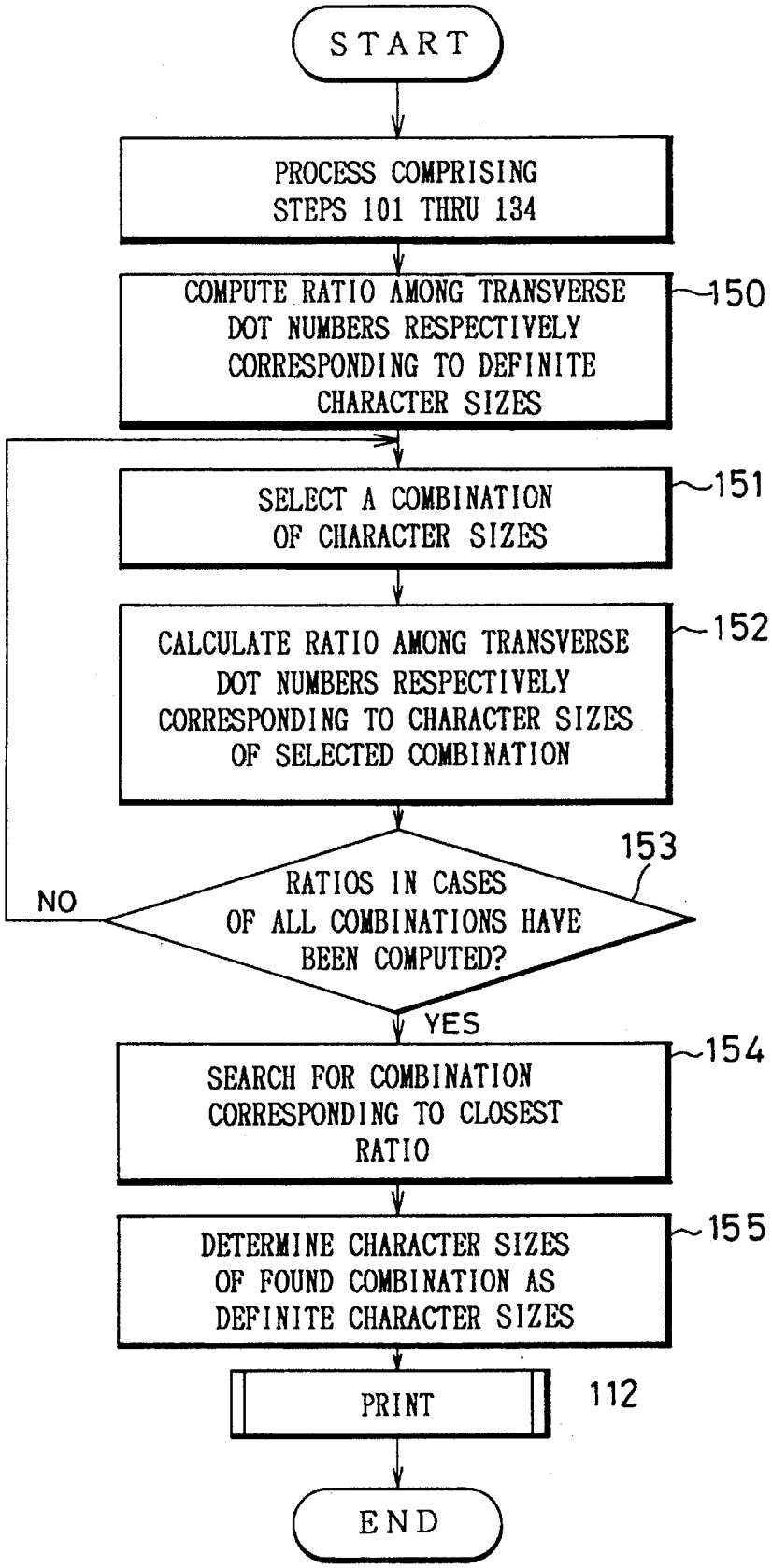
FIG. 5 is a flowchart for illustrating a process to be performed in a character-size entrusting mode of the fourth embodiment of the present invention.

Next, the fourth embodiment of the present invention will be described in detail hereinbelow by referring to the accompanying drawings. FIG. 5 is a flowchart for illustrating the processing program **22*a* to be executed in the character-size entrusting mode in the fourth embodiment to print a text consisting of a plurality of lines of characters. Incidentally, as described above, in case of the fourth embodiment, it is assumed that the font information stored in the CG-ROM 24** represents bitmap fonts.

In case of the fourth embodiment of the present invention, when instructing the output portion to print a text currently displayed on the screen of the LCD 35, the CPU 21 verifies the character size attribute concerning the text and the number of lines of characters of the text. If the character-size entrusting mode is set as the character size attribute and the number of lines is not less than two, the device starts performing the process illustrated in FIG. 5. Incidentally, in this figure, like reference numerals indicates like or corresponding steps of FIGS. 1 and 4.

Incidentally, in case of the fourth embodiment of the present invention, the process comprising the steps of determining the tentative fundamental character size assigned to each line, finding the longest line, selecting a short line as an object of the "searching" process, increasing the tentative fundamental character size assigned to the selected short line from the smallest one of the possible fundamental character sizes to the largest one thereof by stages, calculating the difference between the length of the longest line and the length computed from the current tentative fundamental character size at each stage of the process of increasing the fundamental character size, and temporarily determining the tentative fundamental character size corresponding to the smallest difference as the definite fundamental character size to be assigned to the short line is the same as the process comprising steps 101 to 134 in case of the third embodiment of the present invention. Therefore, the detail description of such a process is omitted here for simplicity of description.

When the definite fundamental character sizes respectively corresponding to (namely, to be respectively assigned to) all of the lines are temporarily determined in the aforementioned way, the ratio between (or among) the transverse dot numbers assigned to the definite fundamental character sizes is computed and the computed ratio is stored in the work area established in the RAM 23 as a reference ratio (in step 150).

Thereafter, a combination of the fundamental character sizes respectively assigned to all of the lines, which combination is permissible in view of the limited number of dots aligned in the transverse direction of tape and the number of the lines of characters of the text to be printed, is first selected in step 151. Next, the ratio among the character sizes of the selected combination is calculated in step 152. Further, the calculation of such a ratio is performed on each of the permissible combinations of character sizes respectively corresponding to all of the lines (in steps 152 and

153).

When employing bitmap fonts in the tape printing device, the available character size has several levels. Thus, if the number of lines is determined, only several combinations of the character sizes respectively assigned to the lines can meet the limitation in number of dots in the traverse direction (namely, in the direction of the width) of tape.

For instance, it is assumed that the available character sizes (in other words, the available levels of the character size) are 16×16 dots, 24×24 dots, 32×32 dots and 48×48 dots, that a 12-mm-wide tape is loaded in the tape printing device and that the number of dots which can be aligned in the direction of the width of the tape (in this case, this number is employed as the limited number of dots in the traverse direction of the tape) is 72. In this case, if an input text consists of two lines or rows of characters, the practical combinations of the character sizes respectively assigned to the two lines are as follows:

(1) In case of a first combination, the fundamental character size assigned to a first line and that assigned to a second line are 48×48 dots and 24×24 dots, respectively. In this case, the number of dots aligned in the transverse direction of the tape is represented by the expression (48+24), using the transverse dot numbers (48 and 24) of the fundamental character sizes respectively assigned to the first and second lines. Hereunder, such an expression will be used to represent another combination of the character sizes in a similar case.

(2) In case of a second combination, the fundamental character size assigned to a first line and that assigned to a second line are 48×48 dots and 16×16 dots, respectively. In this case, the number of dots aligned in the transverse direction of the tape is represented by the expression (48+line space+16), using the transverse dot numbers (48 and 16) of the fundamental character sizes respectively assigned to the first and second lines. Hereinafter, such an expression will be also used to represent another combination of the character sizes in a similar case.

(3) Combination of the fundamental character sizes represented by the expression (32+line space+32).

(4) Combination of the fundamental character sizes represented by the expression (32+line space+24).

(5) Combination of the fundamental character sizes represented by the expression (32+line space+16).

In addition, the following combinations are obtained by interchanging the fundamental character sizes between the first and second lines in the combinations (1), (2), (4) and (5). Namely, (6) Combination of the fundamental character sizes represented by the expression (24+48).

(7) Combination of the fundamental character sizes represented by the expression (16+line space+48).

(8) Combination of the fundamental character sizes represented by the expression (24+line space+32).

(9) Combination of the fundamental character sizes represented by the expression (16+line space+32). For example, in step 151, a combination of the fundamental character sizes is first selected from the combinations (1) to (9).

Similarly, in step 161 of the program to be executed by the fifth embodiment (to be described later), a combination of the fundamental character sizes is first selected from a plurality of the combinations. However, in cases of the combinations of the fundamental character sizes employed in the fifth embodiment, the fundamental character sizes do not relate to the line numbers (namely, the transverse positions of the lines). In this respect, the combinations of the fundamental character sizes employed in the fifth embodiment are different from the combinations (1) to (9) employed in the fourth embodiment, in which the fundamental character sizes correspond to the line numbers, respectively, as described above.

In the aforementioned steps 151 to 153, the ratio between (or among) the transverse dot numbers of the fundamental character sizes of each of the combinations is obtained. Incidentally, in case where the limited number of dots in the transverse direction of the tape is the number of dots determined in accordance with the width of the tape loaded in the tape printing device, the processing in which a detection signal output from the tape-width detecting sensor 12 is received in the control portion 20 during the process comprising steps 151 to 153, is performed. Alternatively, the ratio between (or among) the transverse dot numbers of the permissible fundamental character sizes may be calculated by providing in the ROM 22 a table for preliminarily storing the permissible combinations of the fundamental character sizes corresponding to each value of the number of lines and also storing the transverse dot numbers of the fundamental character sizes of each of the permissible combinations, instead of performing the above described process consisting of steps 151 to 153.

Thereafter, in step 154, the CPU 21 searches, from the permissible combinations of the fundamental character sizes respectively corresponding to the lines, a combination of the fundamental character sizes, the ratio between (or among) the transverse dot numbers of which is closest to the reference ratio between (or among) the definite fundamental character sizes obtained in step 150. Subsequently, the fundamental character sizes of the combination found as a result of the search are finally determined as the definite fundamental character sizes to be respectively assigned to the lines (in step 155). Then, the program starts performing the more practical printing process (in step 112).

Incidentally, in the search of the combinations, what is called a matching distance is employed as an evaluation value. Therefore, the combination of the fundamental character sizes, the ratio between (or among) the transverse dot numbers of which is the same as the reference ratio, is selected most preferentially. If the ratio between (or among) the transverse dot numbers of the character sizes of two or more combinations are the same as the reference ratio, the combination of larger character sizes is selected.

Thus, in case of the fourth embodiment of the present invention, data representing the character-size entrusting mode is stored as the default value data corresponding to the character size, similarly as in case of the aforementioned embodiments of the present invention. Further, when employing this mode, the fundamental character size corresponding to each line is automatically determined and a text is printed on tape. Thereby, a label, on which a text consisting of a plurality of lines of characters arranged as intended by a user is printed, can be easily obtained without producing useless labels by lessening a user's burden as much as possible.

(G) Fifth Embodiment

Figure 6:
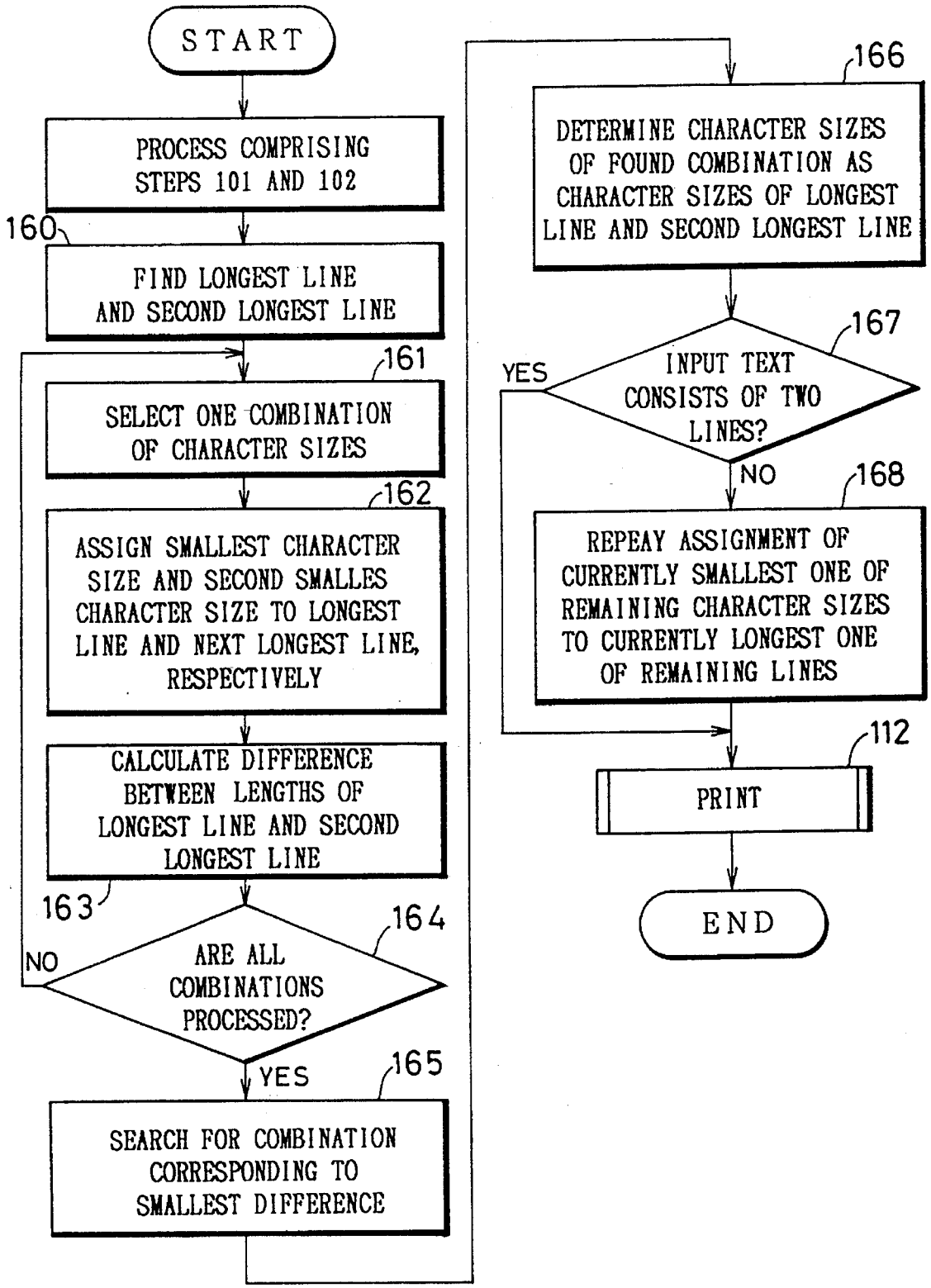
FIG. 6 is a flowchart for illustrating a process to be performed in a character-size entrusting mode of the fifth embodiment of the present invention.

Next, the fifth embodiment of the present invention will be described in detail hereinbelow by referring to the accompanying drawings. FIG. 6 is a flowchart for illustrating the processing program **22*a* to be executed in the character-size entrusting mode in the fifth embodiment to print a text consisting of a plurality of lines of characters. Incidentally, as described above, in case of the fifth embodiment, it is assumed that the font information stored in the CG-ROM 24** represents bitmap fonts.

In case of the fifth embodiment of the present invention, when instructing the output portion to print a text currently displayed on the screen of the LCD 35, the CPU 21 verifies the character size attribute concerning the text and the number of lines of characters of the text. If the character-size entrusting mode is set as the character size attribute and the number of lines is two or more, the device starts performing the process illustrated in FIG. 6. Incidentally, in this figure, like reference numerals indicates like or corresponding steps of FIG. 1.

As illustrated in FIG. 6, the CPU 21 tentatively determines the character size to be assigned to one line, which is obtained by equally dividing the limited number of dots in the direction of the width of the tape (namely, is obtained in case of what is called the uniform character-size layout) in step 101 as the (tentative) fundamental character size assigned to each line. Subsequently, the CPU 21 Calculates the length of each line, based on the tentative fundamental character size assigned thereto, in step 102. Further, the CPU 21 determines the longest line and the second longest line on the basis of the comparison between (or among) the calculated lengths of the lines in step 160.

Further, the CPU 21 selects one of the combinations of the character sizes determined depending on the number of the lines (in step 161). As described above, in case of the fifth embodiment, each of the character sizes of these combinations is not specifically related to the line number (namely, the transverse position of a line) and further each of these combinations is formed by combining the practical character sizes in each case of the number of the lines, regardless of the line numbers (namely, the transverse positions of the lines). Information representing these combinations is stored in the table established in the ROM 22.

Furthermore, the CPU 21 assigns the smallest character size of the selected combination to the longest line and also assigns the second smallest character size of this combination to the second longest line in step 162. Subsequently, the CPU 21 calculates the difference between the lengths of these two lines, based on the character sizes assigned thereto (in step 163). This process is performed on all of the combinations (in steps 161 to 164).

When the difference between the lengths of the longest line and the second longest line corresponding to each of the combinations is obtained in this way, the combination corresponding to the smallest difference is searched for (in step 165). Then, the smallest character size and the second smallest character size of the combination found as a result of the search are determined as the character size to be assigned to the longest line and that to be assigned to the second longest line, respectively in step 166.

Thereafter, it is checked (in step 167) whether or not an input text consists of two lines. If the number of lines of characters of the input text is two, the program immediately advances to step 112 and performs the more practical printing process according to the determined character size corresponding to each of the lines. In contrast, if the number of lines of characters of the input text is not less than three, the character sizes other than the smallest character size and the second smallest character size, which are selected from those of the combination corresponding to the smallest difference, are assigned to the remaining lines, to which no character sizes are assigned, (namely, the lines other than the longest line and the second longest line) in step 168. Incidentally, the assignment of the character sizes to the remaining lines is repeatedly performed in such a manner that the smallest one of the current remaining character sizes of the combination corresponding to the smallest difference is assigned to the longest one of the current remaining lines, the lengths of which have been calculated in step 102.

Therefore, in case of the fifth embodiment of the present invention, data representing the character-size entrusting mode is stored as the default value data corresponding to the character size. Further, when employing this mode, the fundamental character size corresponding to each line is automatically determined in such a fashion that in case of performing the uniform character-size layout, at least two long lines come to have a same length. Then, a text is printed on tape. Thereby, a label, on which a text consisting of a plurality of lines of characters arranged as intended by a user is printed, can be easily obtained without producing useless labels by lessening a user's burden as much as possible.

Incidentally, practically, the number of lines of characters of a text to be treated by the tape printing device is only 4 lines or so at most. In case where a text to be printed consists of such a number of lines, if the two longest lines are made to have a same length, an empty space at the right side of the printed text (especially, at the right side of short lines other than the two longest lines) comes not to look unnatural. Moreover, the processing can be speeded up (namely, the processing time can be shortened) very much, because the calculation of the difference in length between two lines is performed only on a pair of the longest line and the second longest line correspondingly to each of the permissible combinations of the character sizes in the "searching" process as stated above.

(H) Other Embodiments (H-1) In cases of the aforementioned embodiments, the length of each line obtained in step 102 is represented in terms of the number of dots, in the light of the fact that different character sizes may be respectively assigned to a plurality of parts of characters aligned on the same line. It is, however, rare to assign different character sizes to a plurality of parts of characters aligned on the same line. Therefore, the processing may be performed in this step by defining the length of a line as the number of characters of a line. Incidentally, in case of the processing to be performed in another step (for example, step 105), it is necessary to calculate the length of each line in terms of the number of dots. However, when defining the length of a line as the number of characters of the line, the processing can be promoted (namely, the processing time can be shortened).

Meanwhile, some tape printing device for printing alphanumeric characters on tape performs what is called a "proportional printing" of alphanumeric characters (namely, a printing method in which proportionally-spaced fonts are employed and each pair of adjacent character cells aligned on a line are separated by equal space). However, if the number of characters of a line is defined as the length of the line in case of such a tape printing device, the processing can not be precisely performed. Thus, the processing to be performed in, for instance, step 102 may be carried out by preliminarily obtaining the average of the longitudinal dot number (namely, the number of dots in the longitudinal direction of the tape) of each alphanumeric character (hereunder referred to as the average dot number), and then storing the average dot numbers in the ROM 22 and thereafter calculating the length of each line by use of the stored average dot numbers, instead of the number of characters.

Incidentally, either a simple mean or a weighted mean (or average) calculated in consideration of the frequency of occurrence of each alphanumeric character may be employed as the average. (In case where such a weighted mean is employed, the average is obtained by heavily weighting the longitudinal dot number of an alphanumeric character having the high frequency of occurrence (for example, "E") and by lightly weighting the longitudinal dot number of an alphanumeric character having the low frequency of occurrence (for example, "Z")). Alternatively, the tape printing device may utilize length information generated as will be described hereinbelow. Namely, alphanumeric characters are first classified into a plurality of groups (for instance, a group of the characters such as "I" and "J", which are relatively short in the longitudinal direction of tape if printed on tape, and another group of the characters such as "W", which are relatively long in the longitudinal direction of tape if printed thereon). Then, the average value of the longitudinal dot numbers is preliminarily calculated correspondingly to each of the groups. Next, the frequency (or number) of occurrences of the alphanumeric characters of each group in the characters of a line are counted. Then, concerning each of the groups, a product of the counted frequency of occurrences of the characters and the average value of the longitudinal dot numbers is computed. Thereafter, the sum of the computed products respectively corresponding to the groups is obtained. Further, information representing the obtained sum product is utilized as the length information.

(H-2) In cases of the aforesaid embodiments of the present invention, in the character-size entrusting mode, the determination of the character size (and the line pitch) corresponding to each line is performed when instructing the device to print a text. However, such a determination may be performed at another phase or stage of the processing. For example, such a determination may be performed when the input of an text is finished, or when instructing the RAM to store the input text. In such cases, information representing the determined character size (and line pitch) may be stored in the RAM as character size information. Moreover, the character size (information) to be stored may be represented in terms of relative value data (for instance, "LARGE", "MIDDLE" and "SMALL") or absolute value data converted according to the width of tape.

(H-3) In cases of the aforementioned embodiments of the present invention, the character-size entrusting mode is set as the factory-set default value data. As a matter of course, another character-size determination mode (for example, a mode in which the character sizes are equally determined according to the uniform character-size layout) may be set as the default value data. Namely, the character-size entrusting mode may be set as an optional mode which can be selected after the program is activated.

(H-4) The number of lines or rows of characters of each text and the width of tape are not limited to the number and the width as described in the foregoing description of the aforementioned embodiments, respectively. Namely, the tape printing device of the present invention can treat a text consisting of an arbitrary number of lines of characters and also treat a tape of arbitrary width. Incidentally, the character sizes may be changed at some phase or stage in the processing. For example, once, the character size corresponding to each line is determined on the premise that the maximum number of dots, which can be printed in the direction of the width of tape, is set as the limited number of dots. Thereafter, the width of the tape loaded in the device is verified at the time of performing the more practical printing process. Subsequently, the character sizes may be changed according to the width of the tape loaded in the device.

(H-5) In cases of the aforementioned embodiments of the present invention, the character size corresponding to each line may be selected (or determined) from a plurality of character sizes, each of which has the longitudinal dot number being equal to the transverse dot number. However, double width sizes and double height sizes may be selected as the character size corresponding to each line.

In each case of the embodiments described in the paragraphs (H-1) to (H-5), a label, on which a text consisting of a plurality of lines of characters arranged as intended by a user is printed, can be easily obtained without producing useless labels by lessening a user's burden as much as possible.

While preferred embodiments of the present invention have been described above, it is to be understood that the present invention is not limited thereto and that other modifications will be apparent to those skilled in the art without departing from the spirit of the invention.

The scope of the present invention, therefore, is to be determined solely by the appended claims.

What is claimed is:

1. A tape printing device for printing an input text on tape, comprising:

first judgement means for judging whether a number of lines of characters of the input text is not less than two, and whether a character-size entrusting mode, in which a character size corresponding to each line is automatically determined, is selected;

length information generating means for assigning a same character size to all of the lines and generating length information representing a length of each line to which the same character size is assigned when it is judged by the first judgement means that the character-size entrusting mode is selected and the number of lines of characters of the input text is not less than two;

means for tentatively determining and assigning a different character size to at least one line other than a longest line according to the length information so as to make the length of the at least one other line, which is calculated on the basis of the character size assigned thereto, equal to the length of the longest line;

second judgement means for judging whether a total sum of transverse sizes of all of the lines exceeds a predetermined limited size, the total sum being calculated on the basis of the character size assigned by the length information generating means to the longest line and the character size assigned to the at least one other line and determined tentatively by the tentatively determining means;

means for determining the character size assigned by the length information generating means to the longest line and the character size assigned to the at least one other line by the tentatively determining means as the character size attributes of the lines when it is judged by the second judgement means that the total sum of the transverse sizes of all of the lines does not exceed the predetermined limited size; and means for determining the character size attributes of the lines by multiplying the character sizes assigned by the length information generating means to the longest line and assigned to the at least one other line by the tentatively determining means by a coefficient determined according to the limited size and the total sum of the transverse sizes of the lines, when it is judged by the second judgement means that the total sum of the transverse sizes of all of the fines exceeds the predetermined limited size; and print means for printing the input text according to the character-size attribute of each line.

2. A tape printing device for printing an input text on tape, comprising:

first judgement means for judging whether a number of lines of characters of the input text is not less than two, and whether a character-size entrusting mode, in which a character size corresponding to each line is automatically determined, is selected;

length information generating means for assigning a same character size to all of the lines and generating length information representing a length of each line to which the same character size is assigned when it is judged by the first judgement means that the character-size entrusting mode is selected and the number of lines of characters of the input text is not less than two;

means for tentatively determining and assigning a different character size to at least one line other than a longest line according to the length information so as to make the length of the at least one other line, which is calculated on the basis of the character size assigned thereto, equal to the length of the longest line;

means for determining the character-size attributes of the lines by dividing a predetermined limited size of a width of the tape by values respectively corresponding to all of the lines, the values being in proportion to a ratio among the character sizes assigned by the length information generating means to the longest line and by the tentatively determining means to the at least one other line; and print means for printing the input text according to the character-size attribute of each line.

3. A tape printing device for printing an input text on tape, comprising:

first judgement means for judging whether a number of lines of characters of the input text is not less than two, and whether a character-size entrusting mode, in which a character size corresponding to each line is automatically determined, is selected;

length information generating means for assigning a same character size to all of the lines and generating length information representing a length of each line to which the same character size is assigned when it is judged by the first judgement means that the character-size entrusting mode is selected and the number of lines of characters of the input text is not less than two;

means for tentatively determining and assigning a different character size to at least one line other than a longest line according to the length information so as to make the length of the at least one other line, which is calculated on the basis of the character size assigned thereto, become as close as possible to the length of the longest line;

means for determining the character-size attributes of the lines by selecting a combination of character sizes from a plurality of combinations of character sizes predetermined depending on the number of lines of characters of the input text, wherein the selected combination has a character size ratio which is closest to a ratio among the character sizes assigned by the length information generating means to the longest line and assigned to the at least one other line by the tentatively determining means; and print means for printing the input text according to the character-size attribute of each line.

4. A tape printing device for printing an input text on tape, comprising:

judgement means for judging whether a number of lines of characters of the input text is not less than two, and whether a character-size entrusting mode, in which a character size corresponding to each line is automatically determined, is selected;

length information generating means for assigning a same character size to all of the lines and generating length information representing a length of each line to which the same character size is assigned when it is judged by the judgement means that the character-size entrusting mode is selected and the number of lines of characters of the input text is not less than two;

selection means for selecting, from predetermined combinations of character sizes respectively corresponding to the lines, one of the combinations of the character sizes corresponding to the smallest difference in length between a longest line and a second longest line determined according to the length information, the length of the longest line being calculated on the basis of a smallest character size among the character sizes of the predetermined combinations, the length of the second longest line being calculated on the basis of a second smallest character size among the character sizes of the predetermined combinations;

first means for determining a smallest character size and a second smallest character size among the character sizes of the selected combination as character-size attributes of the longest line and the second longest line, respectively;

second means for determining the character-size attributes of any remaining lines by iteratively assigning a smallest one of unassigned character sizes of the selected combination to a longest one of the remaining lines until the unassigned character sizes are assigned to all of the remaining lines of characters of the input text; and print means for printing the input text according to the character-size attribute of each line.

5. A tape printing method for printing a plurality of lines of characters of an input text on tape, comprising:

a first step of assigning a same character size to all of the lines and generating length information representing a length of each line to which the same character size is assigned when a character-size entrusting mode is selected and the number of lines of characters of the input text is not less than two;

a second step of tentatively determining and assigning a different character size to at least one line other than a longest line according to the length information so as to make the length of the at least one other line, which is calculated on the basis of the character size assigned thereto, equal to the length of the longest line;

a third step of judging whether a total sum of transverse sizes of all of the lines, which is calculated on the basis of the character size assigned in the first step to the longest line and the character size assigned to the at least one other line in the second step, exceeds a predetermined limited size;

a fourth step of determining the character size assigned in the first step to the longest line and the character size assigned to the at least one other line in the second step as the character-size attributes of the lines when it is judged in the third step that the total sum of the transverse sizes of all of the lines does not exceed the predetermined limited size;

a fifth step of determining the character size attributes of the lines by multiplying the character sizes assigned in the first step to the longest line and assigned to the at least one other line in the second step by a coefficient determined according to the limited size and the total sum of the transverse sizes of all the lines, when it is judged in the third step that the total sum of the transverse sizes of all of the lines exceeds the predetermined limited size; and a sixth step of printing the input text according to the character-size attribute of each line.

6. A tape printing method for printing a plurality of lines of characters of an input text on tape, comprising:

a first step of assigning a same character size to all of the lines and generating length information representing a length of each line to which the same character size is assigned when a character-size entrusting mode is selected and the number of lines of characters of the input text is not less than two;

a second step of tentatively determining and assigning a different character size to at least one line other than a longest line according to the length information so as to make the length of the at least one other line, which is calculated on the basis of the character size assigned thereto, equal to the length of the longest line;

a third step of determining the character-size attributes of the lines by dividing a predetermined limited size of a width of the tape by values respectively corresponding to all of the lines, the values being in proportion to a ratio among the character size assigned in the first step to the longest line and the character size of the at least one other line determined in the second step; and a fourth step of printing the input text according to the character-size attribute of each line.

7. A tape printing method for printing a plurality of lines of characters of an input text on tape, comprising:

a first step of assigning a same character size to all of the lines and generating length information representing a length of each line to which the same character size is assigned when a character-size entrusting mode is selected and the number of lines of characters of the input text is not less than two;

a second step of tentatively determining and assigning a different character size to at least one line other than a longest line according to the length information so as to make the length of the at least one other line, which is calculated on the basis of the character size assigned thereto, become as close as possible to the length of the longest line;

a third step of determining the character size attributes of the lines by selecting a combination of character sizes from a plurality of combinations of character sizes predetermined depending on the number of lines of characters of the input text, wherein the selected combination has a character size ratio which is closest to a ratio .among the character size assigned in the first step to the longest line and assigned to the at least one other line in the second step; and a fourth step of printing the input text according to the character-size attribute of each line.

8. A tape printing method for printing a plurality of lines of characters of an input text on tape, comprising:

a first step of assigning a same character size to all of the lines and generating length information representing a length of each line to which the same character size is assigned when a character-size entrusting mode is selected and the number of lines of characters of the input text is not less than two;

a second step of selecting, from predetermined combinations of character sizes respectively corresponding to the lines, one of the combination of the character sizes corresponding to the smallest difference in length between a longest line and a second longest line determined according to the length information, the length of the longest line being calculated on the basis of a smallest character size among the character sizes of the predetermined combinations, the length of the second longest line being calculated on the basis of a second smallest character size among the character sizes of the predetermined combinations;

a third step of determining a smallest character size and a second smallest character size among the character sizes of the selected combination, which is selected in the second step, as character-size attributes of the longest line and the second longest line, respectively;

a fourth step of determining the character-size attributes of any remaining lines by iteratively assigning a smallest one of unassigned character sizes of the combination, which is selected in the second step, to a longest one of the remaining lines until the unassigned character sizes are assigned to all of the remaining lines of characters of the input text; and a fifth step of printing the input text according to the character-size attribute of each line.

9. A tape printing method for printing a plurality of lines of characters of an input text on tape, comprising:

a first step of assigning a same character size to all of the lines and generating length information representing a length of each line to which the same character size is assigned when a character-size entrusting mode is selected and the number of lines of characters of the input text is not less than two;

a second step of tentatively determining and assigning a different character size to at least one line other than a longest line according to the length information so as to make the length of the at least one other line, which is calculated on the basis of the character size assigned thereto, become as close as possible to the length of the longest line;

a third step of judging whether a total sum of transverse sizes of all of the lines, which is calculated on the basis of the character size assigned in the first step to the longest line and the character size assigned to the at least one other line in the second step, exceeds a predetermined limited size;

a fourth step of determining the character size assigned in the first step to the longest line and the character size assigned to the at least one other line in the second step as the character size attributes of the lines when it is judged in the third step that the total sum of the transverse sizes of all of the lines does not exceed the predetermined limited size;

a fifth step of judging whether there is a combination of character sizes which are smaller than and ranked next to the character sizes assigned in the first step to the longest line and assigned in the second step to the at least one other line and which combination satisfies a condition that a ratio among the character sizes of the combination is equal to a ratio among the character size assigned in the first step to the longest line and the character size assigned to the at least one other line in the second step, when it is judged in the third step that the total sum of the transverse sizes of all of the lines exceeds the predetermined limited size;

a sixth step of determining the combination of the character sizes, which are smaller than and ranked next to the character sizes assigned to the longest line and the at least one other line, as character size attributes of all of the lines, when it is judged in the fifth step that there is the combination of character sizes;

a seventh step of replacing the character size assigned in the first step to the longest line with a character size which is smaller than and is ranked next to the character size assigned in the first step, and of repeatedly performing processes of the third step to the sixth step, when it is judged in the fifth step that there is no combination of character sizes; and an eighth step of printing the input text according to the character-size attribute of each line.

10. A tape printing device for printing a plurality of lines of characters of an input text on tape, comprising:

first judgement means for judging whether a number of lines of characters of the input text is not less than two;

length information generating means for assigning a same character size to all of the lines and generating length information representing a length of each line to which the same character size is assigned when it is judged by the first judgement means that the number of lines of characters of the input text is not less than two;

means for tentatively determining and assigning a different character size to at least one line other than a longest line according to the length information so as to make the length of the at least one other line, which is calculated on the basis of the character size assigned thereto, equal to the length of the longest line;

second judgement means for judging whether a total sum of transverse sizes of all of the lines exceeds a predetermined limited size, the total sum being calculated on the basis of the character size assigned by the length information generating means to the longest line and the character size assigned to the at least one other line by the tentatively determining means;

means for determining the character size assigned by the length information generating means to the longest line and the character size assigned to the at least one other line by the tentatively determining means as the character-size attributes of the lines when it is judged by the second judgement means that the total sum of the transverse sizes of all of the lines does not exceed the predetermined limited size;

means for determining the character-size attributes of the lines by multiplying each of the character sizes assigned by the length information generating means to the longest line and assigned to the at least one other line by the tentatively determining means, by a coefficient determined according to the limited size and the total sum of the transverse sizes of the lines, when it is judged by the second judgement means that the total sum of the transverse sizes of all of the lines exceeds the predetermining limited size; and print means for printing the input text according to the character-size attribute of each line.

11. A tape printing device for printing a plurality of lines of characters of an input text on tape, comprising:

first judgement means for judging whether the number of lines of characters of the input text is not less than two;

length information generating means for assigning a same character size to all of the lines and generating length information representing a length of each line to which the same character size is assigned when it is judged by the first judgement means that the number of lines of characters of the input text is not less than two;

means for tentatively determining and assigning a different character size to at least one other line other than a longest line according to the length information so as to make the length of each of the at least one other line, which is calculated on the basis of the character size assigned thereto, equal to the length of the longest line;

means for determining the character-size attributes of the lines by dividing a predetermined limited size of a width of the tape by values respectively corresponding to all of the lines, the values being in proportion to a ratio among the character sizes assigned by the length information generating means to the longest line and assigned to the at least one other line by the tentatively determined means; and print means for printing the input text according to the character-size attribute of each line.

12. A tape printing device for printing a plurality of lines of characters of an input text on tape, comprising:

first judgement means for judging whether a number of lines of characters of the input text is not less than two;

length information generating means for assigning a same character size to all of the lines and generating length information representing a length of each line to which the same character size is assigned when it is judged by the first judgement means that the number of lines of characters of the input text is not less than two;

means for tentatively determining and assigning a different character size to at least one line other than a longest line according to the length information so as to make the length of each of the at least one other line, which is calculated on the basis of the character size assigned thereto, become as close as possible to the length of the longest line;

means for determining the character-size attributes of the lines by selecting a combination of the character sizes from a plurality of combinations of character sizes predetermined depending on the number of lines of characters of the input text, wherein the selected combination has a character size ratio closest to a ratio among the character sizes assigned by the length information generating means to the longest line and assigned to the at least one other line by the tentatively determining means; and print means for printing the input text according to the character-size attribute of each line.

13. A tape printing device for printing a plurality of lines of characters of an input text on tape, comprising:

judgement means for judging whether a number of lines of characters of the input text is not less than two;

length information generating means for assigning a same character size to all of the lines and generating length information representing a length of each line to which the same character size is assigned when it is judged by the judgement means that the number of lines of characters of the input text is not less than two;

selection means for selecting, from predetermined combinations of character sizes respectively corresponding to the lines, one of the combinations of the character sizes corresponding to the smallest difference in length between a longest line and a second longest line determined according to the length information, the length of the longest line being calculated on the basis of a smallest character size among the character sizes of the predetermined combinations, the length of the second longest line being calculated on the basis of a second smallest character size among the character sizes of the predetermined combinations;

second means for determining a smallest character size and a second smallest character size among the character sizes of the selected combination as character-size attributes of the longest line and the second longest line, respectively;

third means for determining the character-size attributes of any remaining lines by iteratively assigning a smallest one of unassigned character sizes of the selected combination to a longest one of the remaining lines until the unassigned character sizes are assigned to all of the remaining lines of characters of the input text; and print means for printing the input text according to the character-size attribute of each line.

14. A tape printing method for printing a plurality of lines of characters of an input text on tape, comprising:

a first step of assigning a same character size to all of the lines and generating length information representing a length of each line to which the same character size is assigned when the number of lines of characters of the input text is not less than two;

a second step of tentatively determining and assigning a different character size to at least one line other than a longest line according to the length information so as to make the length of the at least one other line, which is calculated on the basis of the character size assigned thereto, equal to the length of the longest line;

a third step of judging whether a total sum of transverse sizes of all of the lines, which is calculated on the basis of the character size assigned in the first step to the longest line and the character size assigned to the at least one other line in the second step, exceeds a predetermined limited size;

a fourth step of determining the character size assigned in the first step to the longest line and the character size assigned to the at least one other line in the second step as the character-size attributes of the lines when it is judged in the third step that the total sum of the transverse sizes of all of the lines does not exceed the predetermined limited size;

a fifth step of determining the character-size attributes of the lines by multiplying each of the character sizes assigned in the first step to the longest line and assigned to the at least one other line in the second step by a coefficient determined according to the limited size and the total sum of the transverse sizes of the lines, when it is judged in the third step that the total sum of the transverse sizes of all of the lines exceeds the predetermined limited size; and a sixth step of printing the input text according to the character size attribute of each line.

15. A tape printing method for printing a plurality of lines of characters of an input text on tape, comprising:

a first step of assigning a same character size to all of the lines and generating length information representing a length of each line to which the same character size is assigned when the number of lines of characters of the input text is not less than two;

a second step of tentatively determining and assigning a different character size to at least one line other than a longest line according to the length information so as to make the length of the at least one other line, which is calculated on the basis of the character size assigned thereto, equal to the length of the longest line;

a third step of determining character-size attributes of the lines by dividing a predetermined limited size of a width of the tape by values respectively corresponding to all of the lines, the values being in proportion to a ratio among the character sizes assigned in the first step to the longest line and assigned to the at least one other line determined in the second step; and a fourth step of printing the input text according to the character-size attribute of each line.

16. A tape printing method for printing a plurality of lines of characters of an input text on tape, comprising:

a first step of assigning a same character size to all of the lines and generating length information representing a length of each line to which the same character size is assigned when the number of lines of characters of the input text is not less than two;

a second step of tentatively determining and assigning a different character size to at least one line other than a longest line according to the length information so as to make the length of the at least one other line, which is calculated on the basis of the character size assigned thereto, become as close as possible to the length of the longest line;

a third step of determining the character size attributes of the lines by selecting a combination of the character sizes from a plurality of combinations of character sizes predetermined depending on the number of lines of characters of the input text, wherein the selected combination as a character size ratio which is closest to a ratio among the character sizes assigned in the first step to the longest line and assigned to the at least one other line in the second step; and a fourth step of printing the input text according to the character-size attribute of each line.

17. A tape printing method for printing a plurality of lines of characters of an input text on tape, comprising:

a first step of assigning a same character size to all of the lines and generating length information representing a length of each line to which the same character size is assigned when the number of lines of characters of the input text is not less than two;

a second step of selecting, from predetermined combinations of character sizes respectively corresponding to the lines, one of the combinations of the character sizes corresponding to the smallest difference in length between a longest line and a second longest line determined according to the length information, the length of the longest line being calculated on the basis of a smallest character size among the character sizes of the predetermined combinations, the length of the second longest line being calculated on the basis of a second smallest character size among the character sizes of the predetermined combinations;

a third step of determining a smallest character size and a second smallest character-size among the character sizes of the selected combination, which is selected in the second step, as character-size attributes of the longest line and the second longest line, respectively;

a fourth step of determining the character-size attributes of any remaining lines by iteratively assigning a smallest one of unassigned character sizes of the selected combination to a longest one of the remaining lines until the unassigned character sizes are assigned to all of the remaining lines of characters of the input text; and a fifth step of printing the input text according to the character-size attribute of each line.

18. A tape printing method for printing a plurality of lines of characters of an input text on tape, comprising:

a first step of assigning a same character size to all of the lines and generating length information representing a length of each line to which the same character size is assigned when the number of lines of characters of the input text is not less than two;

a second step of tentatively determining and assigning a different character size to at least one line other than a longest line according to the length information so as to make the length of the at least one other line, which is calculated on the basis of the character size assigned thereto, become as close as possible to the length of the longest line;

a third step of judging whether a total sum of transverse sizes of all of the lines, which is calculated on the basis of the character size assigned in the first step to the longest line and the character size assigned to the at least one other line in the second step, exceeds a predetermined limited size;

a fourth step of determining the character size assigned in the first step to the longest line and the character size assigned to the at least one other line in the second step as the character-size attributes of the lines when it is judged in the third step that the total sum of the transverse sizes of all of the lines does not exceed the predetermined limited size;

a fifth step of judging whether there is a combination of character sizes which are smaller than and ranked next to the character sizes assigned to the longest line in the first step and assigned to the at least one other line in the second step and which combination satisfies a condition that a ratio among the character sizes of the combination is equal to a ratio among the character size assigned in the first step to the longest line and the character size assigned to the at least one other line in the second step, when it is judged in the third step that the total sum of the transverse sizes of all of the lines exceeds the predetermined limited size;

a sixth step of determining the combination of the character sizes, which are smaller than and ranked next to the character sizes assigned to the longest line and the at least one other lines, as character size attributes of all of the lines, when it is judged in the fifth step that there is the combination of character sizes;

a seventh step of replacing the character size assigned in the first step to the longest line with a character size which is smaller than and is ranked next to the character size assigned in the first step, and of repeatedly performing processes of the third step to the sixth step, when it is judged in the fifth step that there is no combination of character sizes; and an eighth step of printing the input text according to the character-size attribute of each line.

* * * * *